US007412855B2

(12) United States Patent
Dolev

(10) Patent No.: US 7,412,855 B2
(45) Date of Patent: Aug. 19, 2008

(54) PIVOTAL BAR-LOCK WITH ENCASED CYLINDER LOCK

(76) Inventor: Moshe Dolev, 17 Bereishit St., Ramat Hasharon (IL) 47201

( * ) Notice: Subject to any disclaimer, the term of this patent is extended or adjusted under 35 U.S.C. 154(b) by 367 days.

(21) Appl. No.: 10/556,494

(22) PCT Filed: May 14, 2004

(86) PCT No.: PCT/IL2004/000415

§ 371 (c)(1),
(2), (4) Date: Nov. 14, 2005

(87) PCT Pub. No.: WO2004/101936

PCT Pub. Date: Nov. 25, 2004

(65) Prior Publication Data

US 2006/0196234 A1 Sep. 7, 2006

(51) Int. Cl.
*E05B 67/38* (2006.01)

(52) U.S. Cl. ..... 70/56; 70/2; 70/56; 70/9; 70/11

(58) Field of Classification Search ..... 70/2–13, 70/54–56, 211, 212, 137
See application file for complete search history.

(56) References Cited

U.S. PATENT DOCUMENTS

| | | | | | |
|---|---|---|---|---|---|
| 136,877 | A | * | 3/1873 | Stimens et al. | 70/11 |
| 563,602 | A | * | 7/1896 | Lippitt | 70/11 |
| 1,045,983 | A | * | 12/1912 | Jones | 70/13 |
| 1,112,246 | A | * | 4/1914 | Adler | 70/96 |
| 1,360,057 | A | * | 11/1920 | Tracy | 70/13 |
| 1,598,286 | A | * | 8/1926 | La Marsh | 70/10 |
| 1,673,329 | A | * | 6/1928 | Hart | 70/9 |
| 1,726,162 | A | | 8/1929 | Pique | |
| 2,166,660 | A | * | 7/1939 | Handshy et al. | 70/9 |
| 2,223,876 | A | * | 12/1940 | Scanlan | 70/91 |
| 2,443,850 | A | * | 6/1948 | Clapp | 70/89 |
| 2,734,373 | A | * | 2/1956 | Scherbinski | 70/13 |
| 2,825,218 | A | * | 3/1958 | O'Brien | 70/7 |
| 3,995,459 | A | * | 12/1976 | Weeks et al. | 70/13 |
| 4,548,058 | A | | 10/1985 | Bahry | |
| 4,627,248 | A | * | 12/1986 | Haworth | 70/134 |
| 2005/0016229 | A1 | * | 1/2005 | Evans | 70/9 |
| 2006/0144100 | A1 | * | 7/2006 | Thomsen | 70/2 |

* cited by examiner

*Primary Examiner*—Suzanne Dino Barrett
(74) *Attorney, Agent, or Firm*—Adv. Edward Langer, Esq.; Shibolet & Co.

(57) ABSTRACT

A pivotal bar-lock comprising an anchor hasp having a locking hub and a first locking element integrally formed with a first mounting plate; a locking hasp integrally formed with a second mounting plate and having a mating element and a second locking element formed therein; and a locking bar rotatably mounted on the anchor hasp, the locking bar having a cylinder lock encased therein and an engagement element formed therewith, the cylinder lock being operable such that when rotated into an unlocked mode, the locking bar is pivotally enabled to assume one of open, in-transit, and closed positions in interaction with the first and second locking elements, and when the cylinder lock is rotated into a locked mode, the engagement element of the locking bar engages the mating element of the locking hasp.

24 Claims, 24 Drawing Sheets

PIVOTAL BAR-LOCK WITH ENCASED CYLINDER LOCK

FIELD OF THE INVENTION

The present invention relates generally to bar-locks, and more particularly to an encased bar-lock provided with a cylinder lock mounted on a pivotal bar, enabling barring and locking functions with a high degree of security against tampering and breakage.

BACKGROUND OF THE INVENTION

The bar-lock is a type of lock known for thousands of years. This type of lock was in use in ancient walled cities, in which a large brace, typically a piece of timber wood, or an entire tree trunk, was placed against the width of a gate from the inside, the gate normally opening inward as shown in prior art FIG. 1A. In later prior art, a metal bar was placed in U-shaped or L-shaped anchor braces fastened to each side of the gate posts to hold the bar firmly against the gate, thus preventing the gate from opening, as shown in prior art FIG. 1B. With advances in technological developments, the locking function of the bar-lock was limited to locking stables, barns, sheds, and the like, where the brace locks the doors from the outside and prevents the exit of livestock from secure areas. Additional prior art designs of bar type locks are shown in FIGS. 2-5.

A modern example of the prior art use of bar-locks is described in U.S. Pat. No. 4,548,058 to the present inventor, in which protected hasps are mounted alongside the opening of, for example, a double-door (see FIG. 6) so as to mesh when the doors are closed, with a padlock body being inserted within one opening in the hasps to join with a shackle inserted into an opposing opening in the hasps and locked in place with a key. This is known as a protected hasp lock.

Protected hasp locks, such as that described, are inconvenient to use. This is because once the padlock is opened, the padlock body and shackle must be stored until the lock is re-closed, and they may be misplaced and difficult to find. In addition, it is inconvenient and sometimes difficult for a user to operate the prior art padlock with only one hand free, since it needs both hands in order hold the lock body at the same time as using a key.

Therefore, it would be desirable to provide a lock having the advantageous security features of the protected hasp lock, and the simplicity of a bar-lock.

SUMMARY OF THE INVENTION

Accordingly, it is a principal object of the present invention to overcome the disadvantages associated with the prior art and to provide a bar-lock having a cylinder lock, with the entire lock being encased and fully protected from tampering or breakage by unauthorized intrusion.

In accordance with a preferred embodiment of the present invention, there is provided a pivotal bar-lock comprising:

an anchor hasp comprising a locking hub and a first locking means integrally formed with a first mounting plate;

a locking hasp integrally formed with a second mounting plate and having a mating element and a second locking means formed therein; and a locking bar rotatably mounted on said anchor hasp, said locking bar having a cylinder lock encased therein and an engagement means formed therewith;

said cylinder lock being operable such that when rotated into an unlocked mode, said locking bar is pivotally enabled to assume one of open, in-transit, and closed positions in interaction with said first and second locking means, and when said cylinder lock is rotated into a locked mode, said engagement means of said locking bar engages said mating element of said locking hasp.

In an exemplary embodiment, the key-operated cylinder lock is mounted on the locking bar of the bar-lock, and a locking cam operated by the cylinder lock engages a locking channel formed between the first and second mounting plates, enabling locking of the locking bar when closed on the locking hasp integrally formed on the second mounting plate, with the locking bar being secured in place when the bar-lock is locked.

In the preferred embodiment, the cylinder lock and locking cam are entirely encased in a locking bar having an increased thickness and mass, to provide additional security. The locking bar is designed as an integrally formed unit, without external openings except for a key opening which is kept to a minimal size so as to discourage and prevent tampering, drilling, and other attempts at forced intrusions, such as with a crowbar, saw, wire cutter, drill or other similar implements.

A feature of the invention is that the locking bar is spring-loaded to establish the open and closed positions, enabling the bar-lock to be operated with one hand.

Another feature of the invention is that the locking hasp and the anchor hasp are laterally joined in the same plane by a tightening assembly to define a mounting template for complete, accurate, safe and easy installation, using auxiliary, small diameter mounting screws to assist in the installation.

In one embodiment the first mounting plate of the anchor hasp and the second mounting plate of the locking hasp are co-planar.

In an alternative embodiment, the locking hasp has a mounting surface additional to the second mounting plate, which is not co-planar with the second mounting plate, enabling mounting of the locking hasp on various types of doors.

The bar-lock of the present invention is designed so that the anchor hasp is mounted with a single main, massive fastening means coincident with an axis defining the locking bar rotation, with the fastening means being tamper-resistant.

An advantage of the present invention is that the entire locking bar serves as a locking bolt.

In one embodiment of the present invention, the locking means is a channel having formed therein a first locking bay defined as a closed position locking bay, and a second locking bay defined as an open position locking bay, the first and second locking bays being disposed at opposing ends of the channel.

When the locking bar is pivoted to engage the mating element of the locking hasp, the channel engages a locking cam in the closed position locking bay, locking the pivotal bar-lock.

When the locking bar is pivoted to disengage from the mating element and the locking hasp, the channel engages the locking cam in the open position locking bay, thus securing the locking bar in the open position.

A feature of the invention is the design of the locking cam, which is formed with a partial circumferential collar, with the collar being supported on the cylinder lock, thereby eliminating forced-opening pressure acting on an internal mechanism associated with the cylinder lock.

An additional feature of the invention is that the collar is formed with at least one notch which engages a spring-loaded plunger, to define at least one of the open, in-transit and closed positions.

Another additional feature of the invention is that the anchor hasp and locking bare are integrally formed, respectively, with first and second sets of connecting lugs which are rotatably interlocked in the open and closed positions, preventing disassembly of the locking bar from the anchor hasp. The locking bar can be disassembled from the anchor hasp for maintenance purposes when the locking bar is the in-transit position to enable clearance of the first and second connecting lugs.

Yet another additional feature of the invention is the provision of a spring to establish the open and closed positions of the locking bar, with the spring additionally assisting in maintaining the locking bar on the anchor hasp, preventing its accidental removal until the spring is removed for disassembly of the locking bar.

The present invention also features the provision of engagement means as a latch portion of the locking bar which is rotatable to engage said mating element of the locking hasp in the closed position, with the cylinder lock being operable to lock it therein. The latch portion may be designed to have a latching channel, to enable locking of sliding doors.

Another feature of the present invention is the provision of an adapter means for mounting at least one of the anchor hasp and the locking hasp. The adapter means enables mounting of the pivotal bar-lock on glass doors, aluminum frame doors, or mounting to a metal frame without fasteners.

Another feature of the invention is the ability to mount the anchor hasp and locking hasp on at least one of a variety of door types and opening directions, including reversible doors, single and double doors, swinging, sliding, folding, accordion-type, and rotating doors. The doors may be constructed from materials selected from at least one of the group of wood, plastic, metal, and glass.

Additional features and advantages of the present invention will become apparent from the following drawings and description.

BRIEF DESCRIPTION OF THE DRAWINGS

For a better understanding of the invention with regard to the embodiments thereof, reference is made to the accompanying drawings, not shown to scale, in which numerals designate corresponding elements or sections throughout, and in which.

DETAILED DESCRIPTION OF THE PREFERRED EMBODIMENTS

Figure 1A:
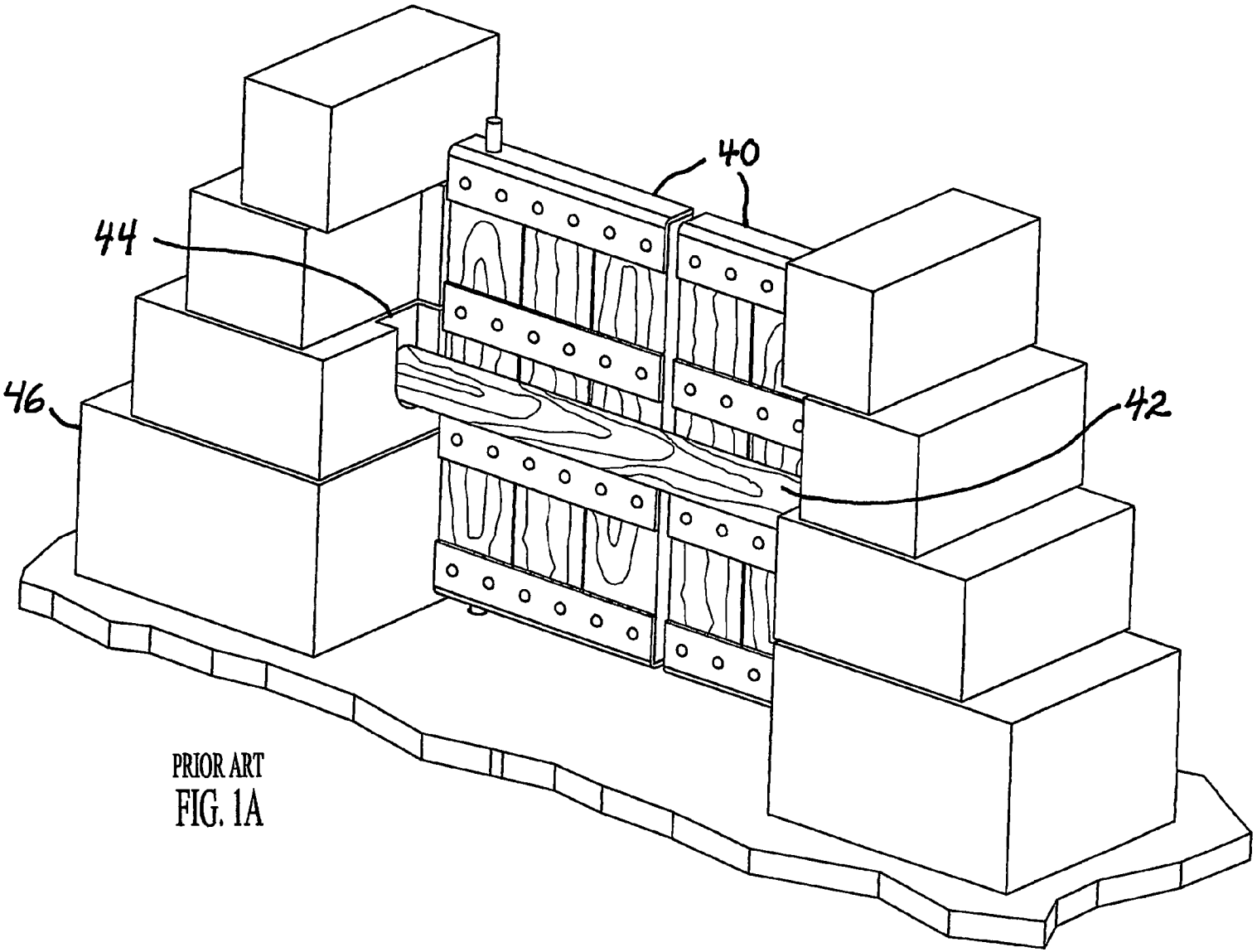
PRIOR ART FIG. 1A
FIG. 1A is a prior art illustration showing a fortified gate as seen from within a walled fort which is barred using a timber beam.
Figure 1B:
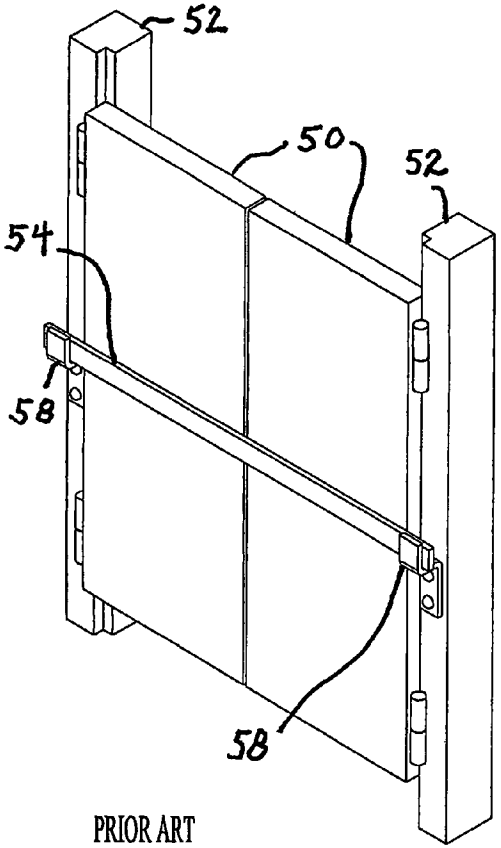
PRIOR ART FIG. 1B
FIG. 1B is a prior art illustration showing double doors, which are locked using a classic type bar-lock engaged between anchors attached to the door frames.
Figure 2:
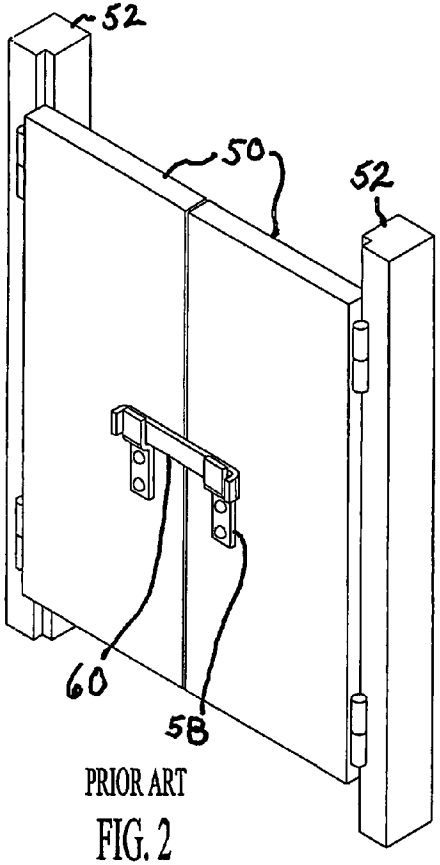
PRIOR ART FIG. 2
FIG. 2 is a prior art illustration showing double doors, which are locked using a shortened bar-lock engaged between anchors attached to the doors themselves.
Figure 3:
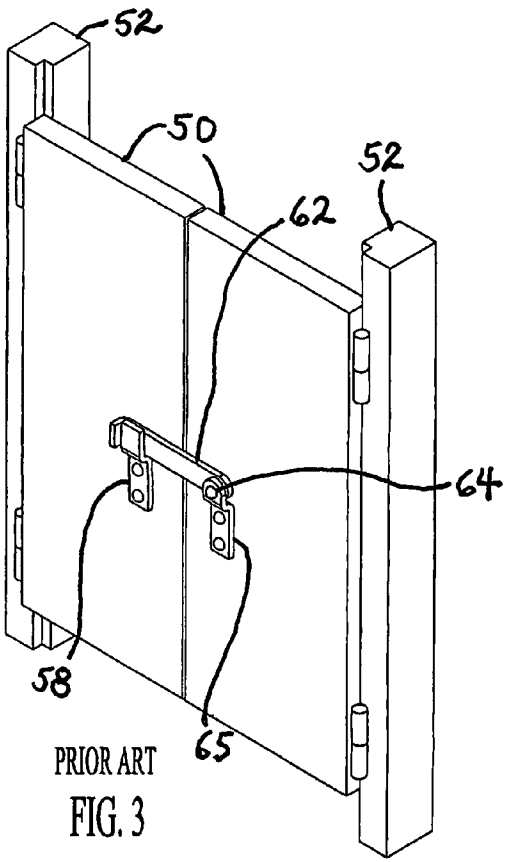
PRIOR ART FIG. 3
FIG. 3 is a prior art illustration showing double doors, which are locked using a shortened bar-lock arranged to pivot on an axle attached to one of the doors and engaged in an anchor attached to the second door.
Figure 4:
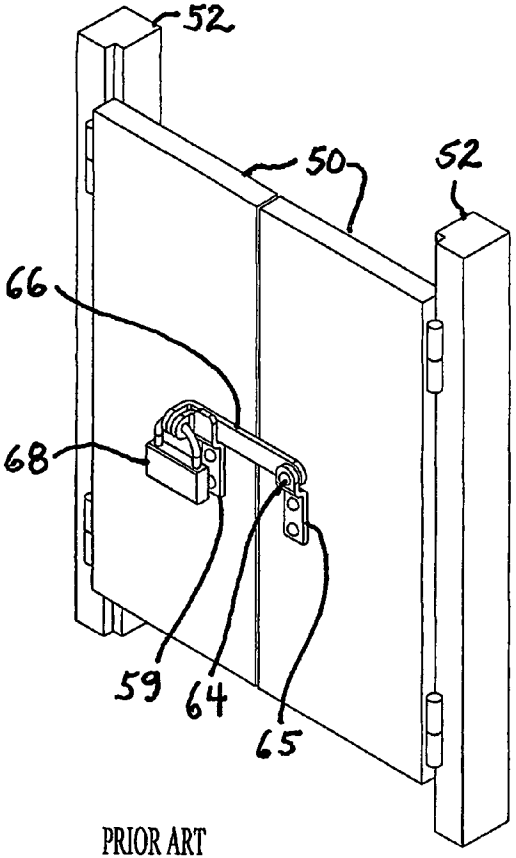
PRIOR ART FIG. 4
FIG. 4 is a prior art illustration showing double doors, which are locked using a shortened, pivotal bar-lock as in FIG. 3, but additionally secured by a conventional padlock.

Referring now to FIG. 1A there is shown an example of an ancient prior art configuration of fortified, double doors 40 barred with a timber member 42 which is secured within keepers 44 formed in the stone walls 46. In FIGS. 1B and 2-4, there are shown alternative prior art configurations of double doors 50 with supporting door posts 52 adapted to use simple bars 54, 60, 62, 66, and 67, respectively, for securing the doors in a closed, barred condition. In FIG. 1B, the bar 54 is mounted between the doorposts 52 using bar keepers 58 to hold bar 54 securely in place. In FIG. 2, a short bar 60 is mounted across the doors 54 and secured in place using bar keepers 58 attached directly to double doors 50. In FIG. 3, bar 62 is pivotal about an axis 64 of a bar anchor 65 and secured in bar keeper 58, both bar keeper 58 and bar anchor 65 being mounted on double doors 50. In FIG. 4, double doors 50 are barred with a pivotal bar 66 rotatable at axis 64 of bar anchor 65 which is mounted to one of the doors 50. Bar 66 is rotated and secured into bar keeper 59 which is disposed on the second door and adapted to be locked with a conventional padlock 68.

Figure 5:
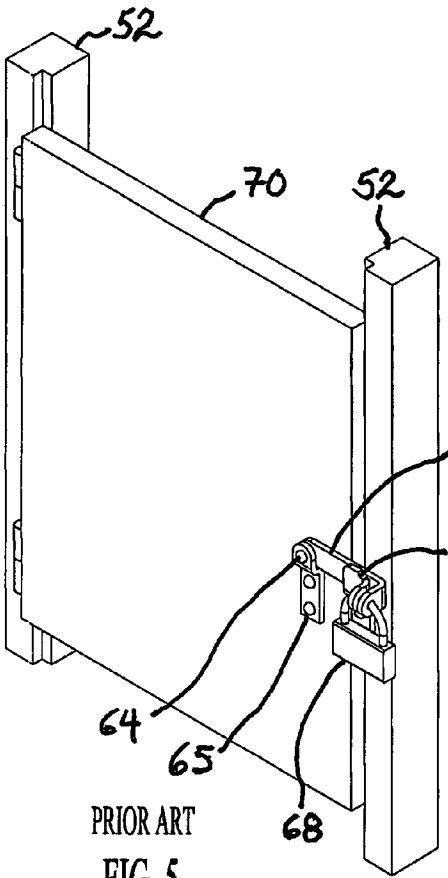
PRIOR ART FIG. 5
FIG. 5 shows a prior art illustration of a single, right-hand door locked with a short pivotal bar secured in a bar keeper attached to a door frame and locked with a padlock.

FIG. 5 shows an alternative prior art configuration of a single, left-hand, reverse door 70, supported on door posts 52 and locked with a pivotal bar 67 rotatable at axis 64 of bar anchor 65 and secured in bar keeper 69 which is adapted to be locked with a padlock 68.

Figure 6:
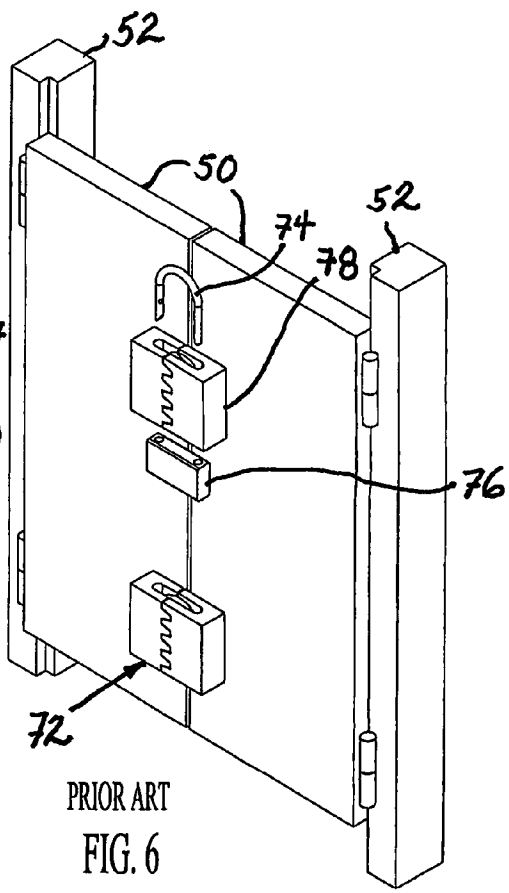
PRIOR ART FIG. 6
FIG. 6 is a prior art illustration showing double doors locked using a protected hasp lock provided as a split padlock per the invention of U.S. Pat. No. 4,548,058.

FIG. 6 shows a prior art configuration of a double door 50 adapted to use a pair of prior art locks in the form of a protected hasp lock 72, as described in U.S. Pat. No. 4,548,058, to the present inventor. Hasp lock 72 in the lower portion of doors 50 is shown in a locked condition and the manner for assembly of the major components of hasp lock 72, shown mounted in the upper portion of doors 50, are indicated by the arrows. The lock shackle 74 is inserted into a protective body 78 of hasp lock 72 at an upper end thereof and engages a padlock body 76 inserted from a lower end of protective body 78. Since the parts of padlock 72 are inside protective body 78, they are tamper-proof and the padlock 72 is protected against forced breakage.

Figures 7A, 7B, 7C, 7D, 7E:
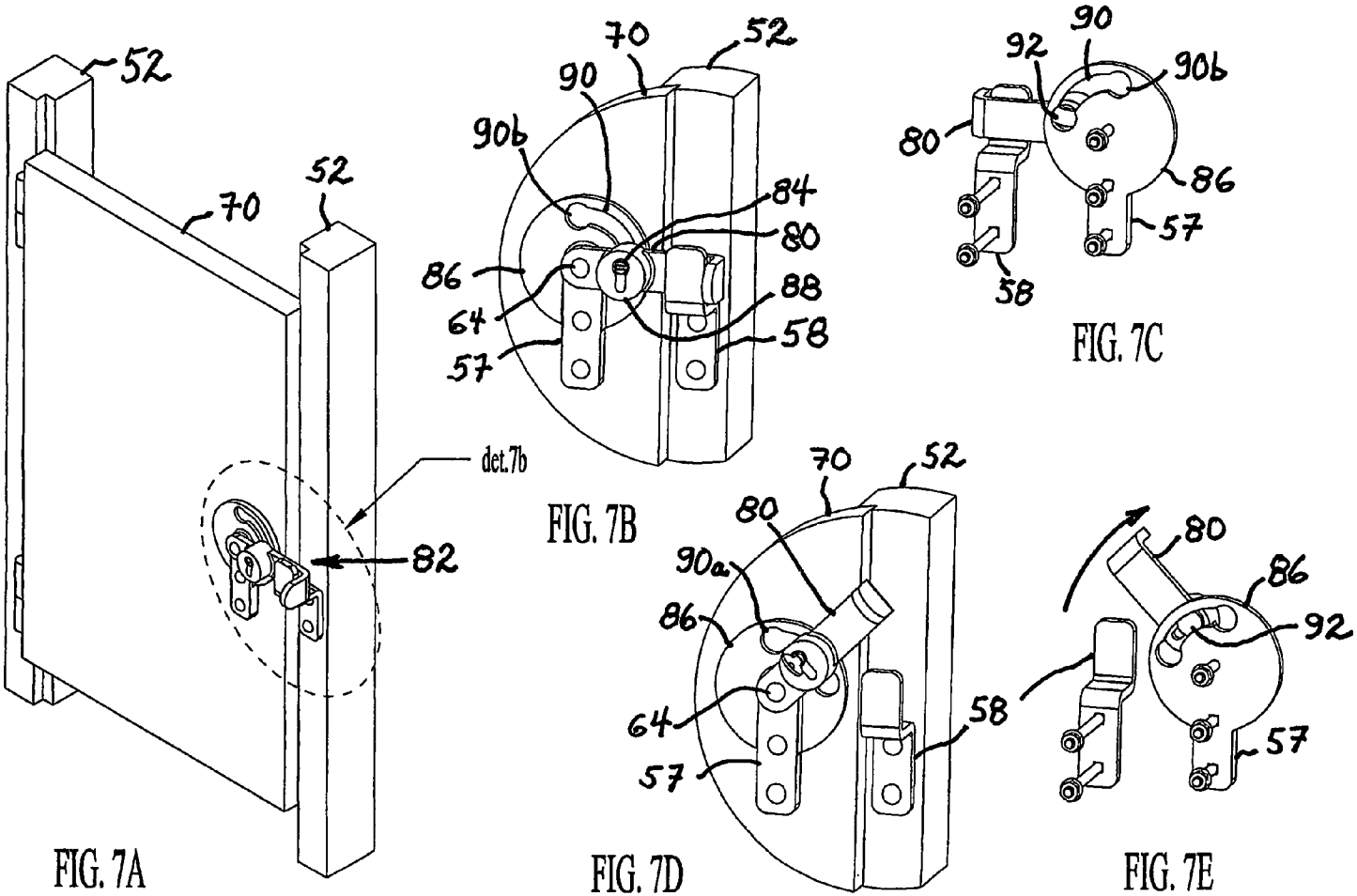
FIG. 7A illustrates a single door locked with a short, pivotal bar-lock in accordance with a preferred embodiment of the invention.
FIG. 7B shows an enlarged detail of a portion of the door of FIG. 7A locked with a preferred embodiment of a pivotal bar-lock, constructed and operated in accordance with the principles of the present invention.
FIG. 7C shows a rear, detailed view of the lock shown in FIGS. 7A and 7B.
FIG. 7D shows a portion of the door of FIG. 7A with an enlarged, detailed view of the lock mounted thereon in an unlocked condition and pivoted in a halfway open position allowing the door to be opened.
FIG. 7E shows a rear, detailed view of the lock shown in FIG. 7D.

Referring now to FIG. 7A, there is illustrated a single, left-hand, reverse door 70 supported on door posts 52, locked with a short, pivotal bar 80 rotatable at axis 64 of bar anchor 57 and secured in bar keeper 58 which is attached to one of door posts 52. Pivotal-bar 80 is provided with an integral bar-lock 82 having a cylinder lock 84 (see detail FIG. 7B) in accordance with a preferred embodiment of the invention.

FIG. 7B is an enlarged detail of the door 70 and door post 52 from FIG. 7A having a preferred embodiment of a pivotal bar-lock, constructed and operated in accordance with the principles of the present invention.

Bar-lock 82, in the embodiment of the present invention shown in FIG. 7; comprises the elements: an anchor plate 86, integral to bar anchor 57, configured with a channel 90 having a locked position bay 90*a* and an unlocked and secured position bay 90*b* formed at opposing ends thereof; pivotal bar 80; cylinder lock 84; and cylinder housing 88 forming an integral part of bar 80.

FIG. 7C shows a rear, detailed view of the lock from FIGS. 7A and 7B. In FIG. 7C, anchor plate 86 is seen from a rear perspective to be formed integral to bar anchor 57, and having formed therein an arc-shaped channel 90, having at one end thereof a locked position bay 90*a* and at the other end thereof, an unlocked and secured position bay 90*b*. Locking cam 92 is shown engaged within channel 90, by way of example, in locked position bay 90*a* with bar 80 locked in bar keeper 58.

FIG. 7D is an enlarged, detailed view of door 70 from FIG. 7A showing bar-lock 82 mounted thereon in an unlocked condition and pivoted, as indicated by the curved arrow, in a halfway open position allowing the door to be opened. Bar 80 is not locked when locking cam 92 is in-transit between bays 90*a* and 90*b*.

FIG. 7E shows a rear, detailed view of the lock of FIG. 7D.

Using a key 96 to unlock bar-lock 82 allows pivotal bar 80 to pivot as indicated by the curved arrow around axis 64 of bar anchor 57. Thus, as bar 80 pivots on axis 64 between the unlocked position at bay 90*b* and locked position at bay 90*a*, locking cam 92 (visible in FIGS. 7C and 7E) moves in channel 90.

When locking cam 92 is in one of the extreme positions of channel 90, in either of locked position bay 90*a* or unlocked and secured position bay 90*b*, it can be rotated respectively, to a locked or unlocked position by use of key 96, which is inserted into cylinder lock 86.

Figure 7G:
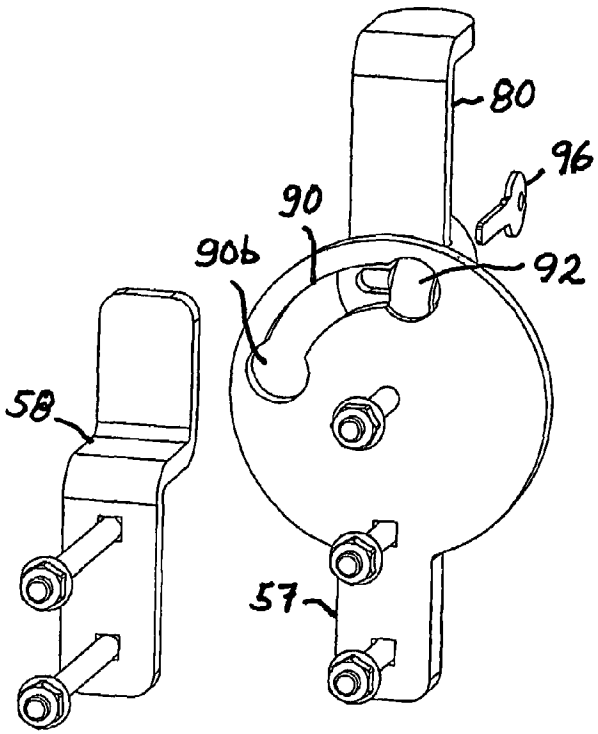
FIG. 7G shows a rear, detailed view of the lock shown in FIG. 7F.
Figure 7F:
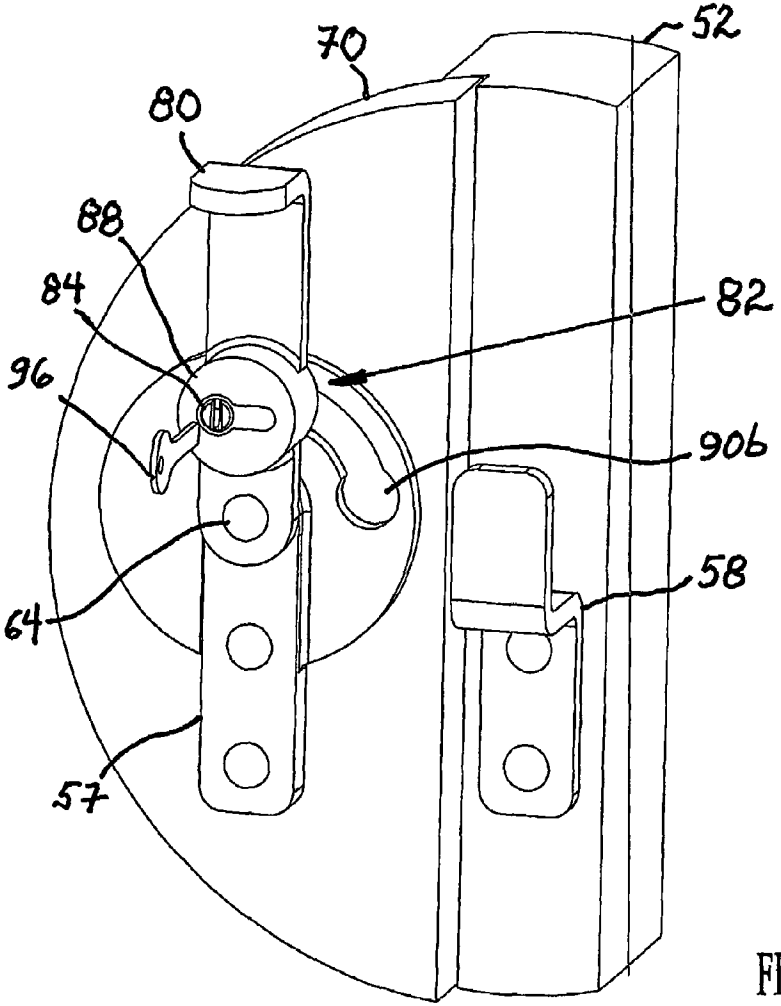
FIG. 7F shows a portion of the door of FIG. 7A with an enlarged, detailed view of a lock mounted thereon in an unlocked and secured position, enabling the door to be opened.

FIG. 7F shows an enlarged, detailed view of door 70 of FIG. 7A, with bar-lock 82 mounted thereon, in an unlocked and secured position, enabling the door to be opened.

FIG. 7G shows a detailed, rear view of the bar-lock of FIG. 7F.

It will thus be appreciated that pivotal bar-lock 82 can be locked in place both in the locked position while secured in bar anchor 58 and in the opened and secured position as shown in FIG. 7F. While it is clearly apparent and essential that pivotal bar-lock 82 be lockable in the locked position, it may be less apparent why bar-lock 82 should be lockable in the open position. However, this is an important feature of the invention, as it increases the level of security against accidental or malicious closure of locking bar 80 on door 70 of a room while people are inside.

It can be readily seen that bar-lock 82 is simpler, more convenient, and more secure to use than the prior art bar-locks described heretofore, since all of its component parts are integrated and the user can operate bar-lock 82 using only key 96, to open and lock it. The present invention is thus more useful than a common padlock, which must be removed and secure the hasp. An unused hasp is subject to abuse and the present invention prevents it from being locked by an unauthorized person.

Bar-lock 82 is also more secure in use, since it does not use a shackle as in the protected hasp lock of the prior art shown in FIG. 6, and is therefore not vulnerable to attempts to break the lock by using a bar cutter to cut the shackle, or a crowbar to pry open the lock.

Figures 8, 9:
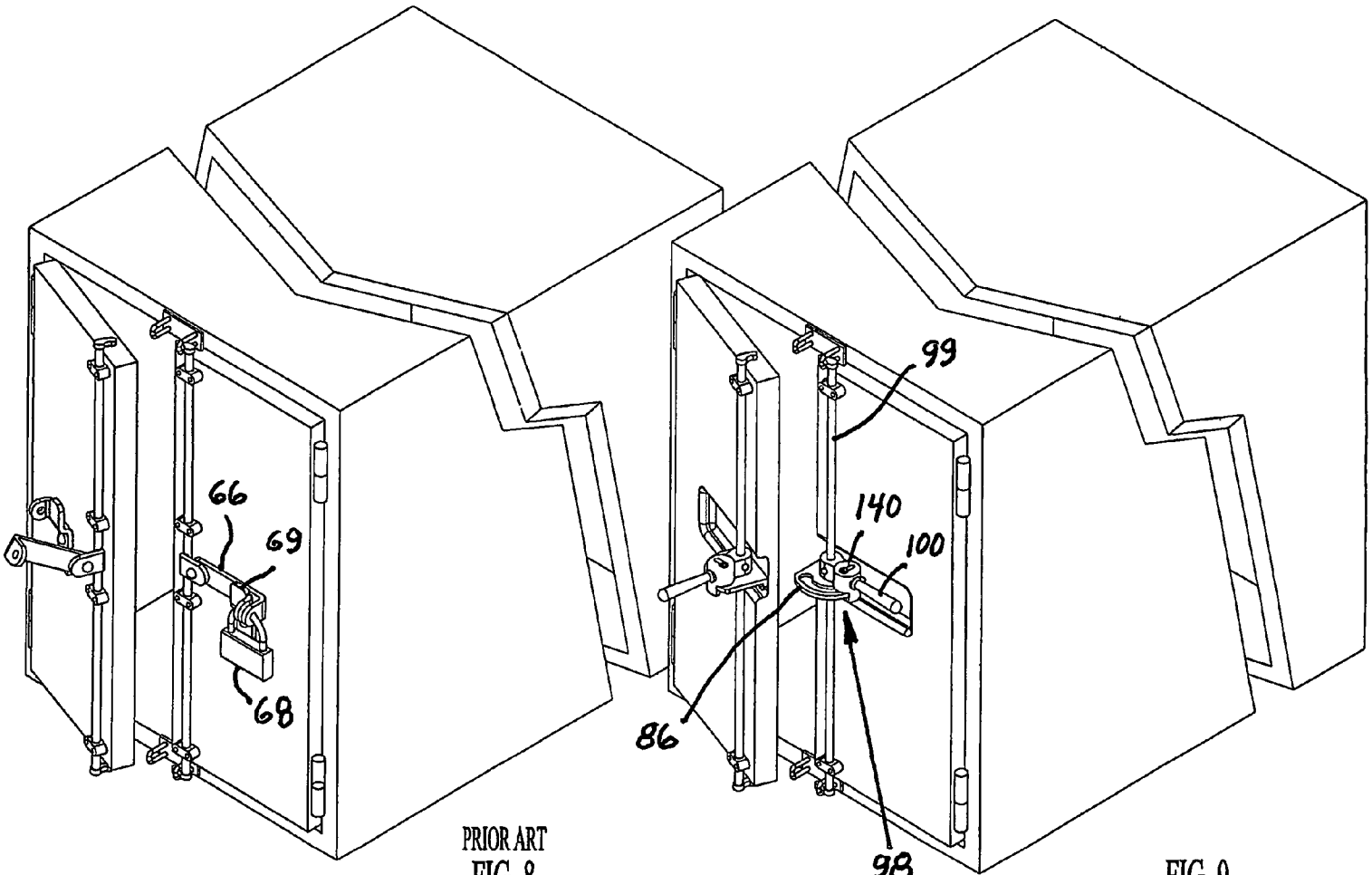
FIG. 9 PRIOR ART
FIG. 8 shows a prior art locking system for a conventional shipping container based on a pivotal bar-lock with a padlock as in FIGS. 4-5.
FIG. 9 shows a locking system for a conventional shipping container in accordance with a preferred embodiment of the present invention.

FIG. 8 shows a prior art locking system for a conventional shipping container. Note that rotatable bar 66 is secured in bar keeper 69 as in FIG. 5 and is adapted to be locked with padlock 68.

FIG. 9 shows a locking system for a conventional shipping container in accordance with a preferred embodiment of the present invention. The ease of use and security are apparent in contrast to the, prior art lock shown in FIG. 8. Pivotal bar-lock 98 in this embodiment of the invention is provided with a handle 100 for pivoting it so that the locking cam (not visible) engages stopping bay 90*a* or 90*b*, and can be locked into either position by use of the cylinder lock 140 and a key (not shown). Anchor plate 86 is mounted in a horizontal plane and fixed to a door around a vertical, door-locking rod 99 used to lock shipping containers.

Figure 10B:
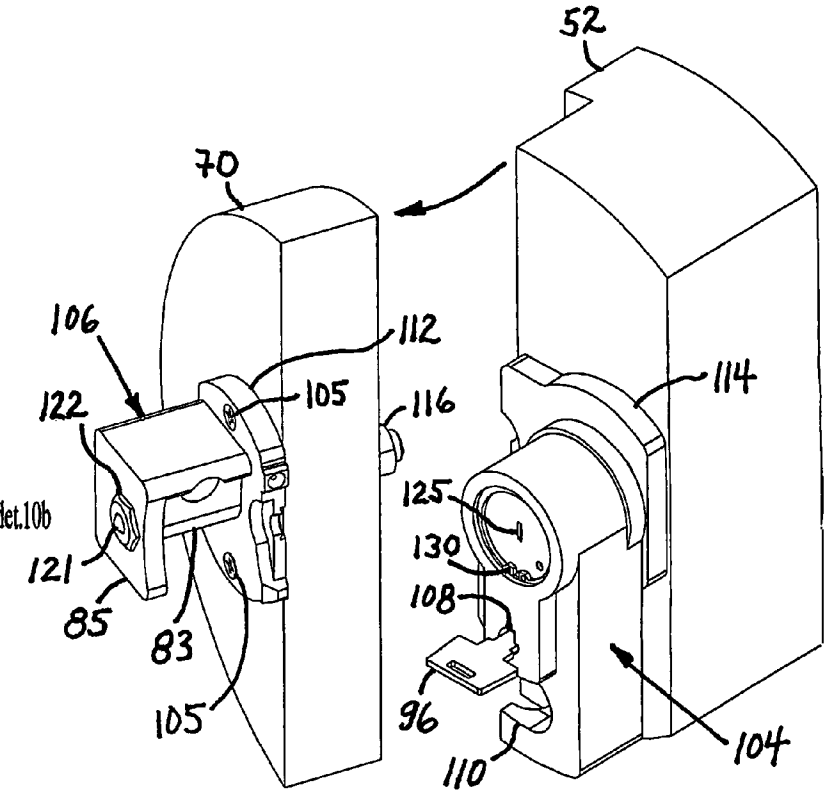
FIG. 10B shows an enlarged, detailed view of the lock of FIG. 10A with a view of a portion of the door opened and the bar-lock unlocked and secured in position.
Figure 10A:
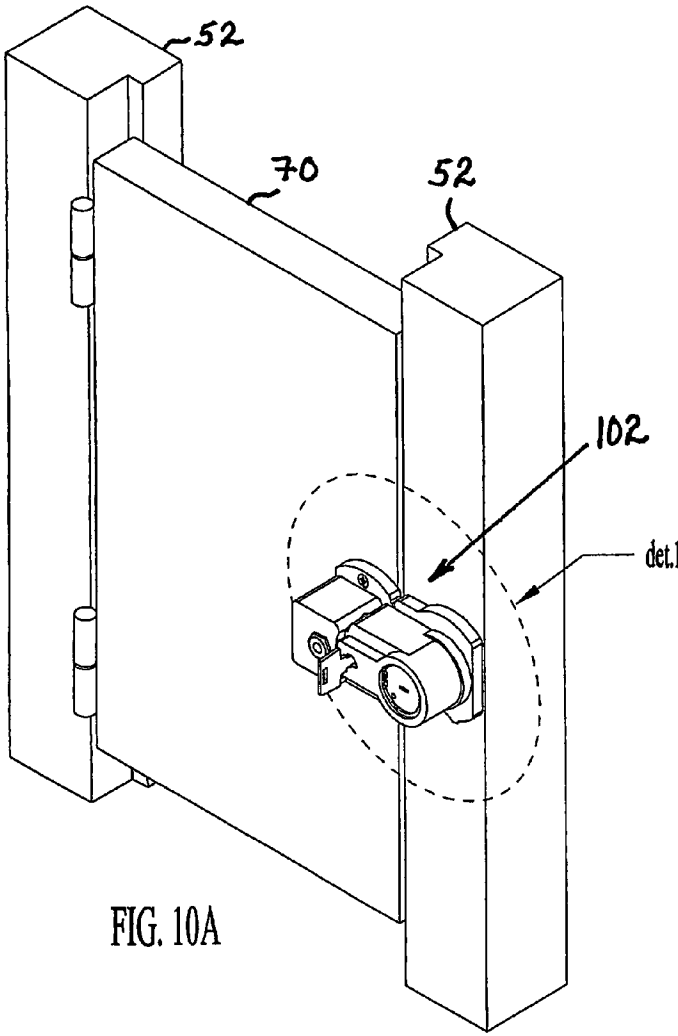
FIG. 10A shows a single, right-hand door, opening outwardly, which is locked using a bar-lock in accordance with an embodiment of the present invention.

FIG. 10A shows a single, left-hand, reverse door, which is locked using a bar-lock in accordance with an embodiment of the present invention. Door 70 is shown closed and locked with bar-lock 102 which is attached to door 70 and an adjoining door-post 52.

FIG. 10B shows an enlarged, detailed view of the bar-lock 102 of FIG. 10A with a view of a portion of door 70 from FIG. 10A, shown opened, and locking bar 104 in an unlocked and secured position.

The locking hasp 106 is integrally formed with a keeper 83 for engaging a latching channel 110 formed in latch portion 119. The latch portion 119 forms an end of locking bar 104, which, when engaged with keeper 83, prevents sliding type doors fitted and locked with bar-lock 102 from being opened or moved. When a bar-lock 102 is installed and locked on swinging type doors, the doors are prevented from opening by the inside face of wall 85 and by abutment with an inner face of mounting plate 112.

It should be appreciated that this embodiment of the invention uses a novel, shaped cylinder lock key opening 108 for receiving key 96 to unlock or lock a cylinder lock (not shown) mounted integrally on locking bar 104. Locking bar 104 is attached to door post 52 via a mounting plate 114 of anchor hasp 155. Locking hasp 106 is attached to door 70 of FIG. 10A via mounting plate 112 using fasteners 105, such as screws. Fasteners 105 serve as auxiliary mounting hardware until larger sized bolts 122 are inserted to secure bar-lock 102 onto a mounting surface of a door or door post. One-way screws, which are not subject to unscrewing, can be employed for initial mounting of bar-lock 102, or the drives on ordinary auxiliary screws can be destroyed since they are left in place for convenience and for added security.

Figures 11A, 11B, 12:
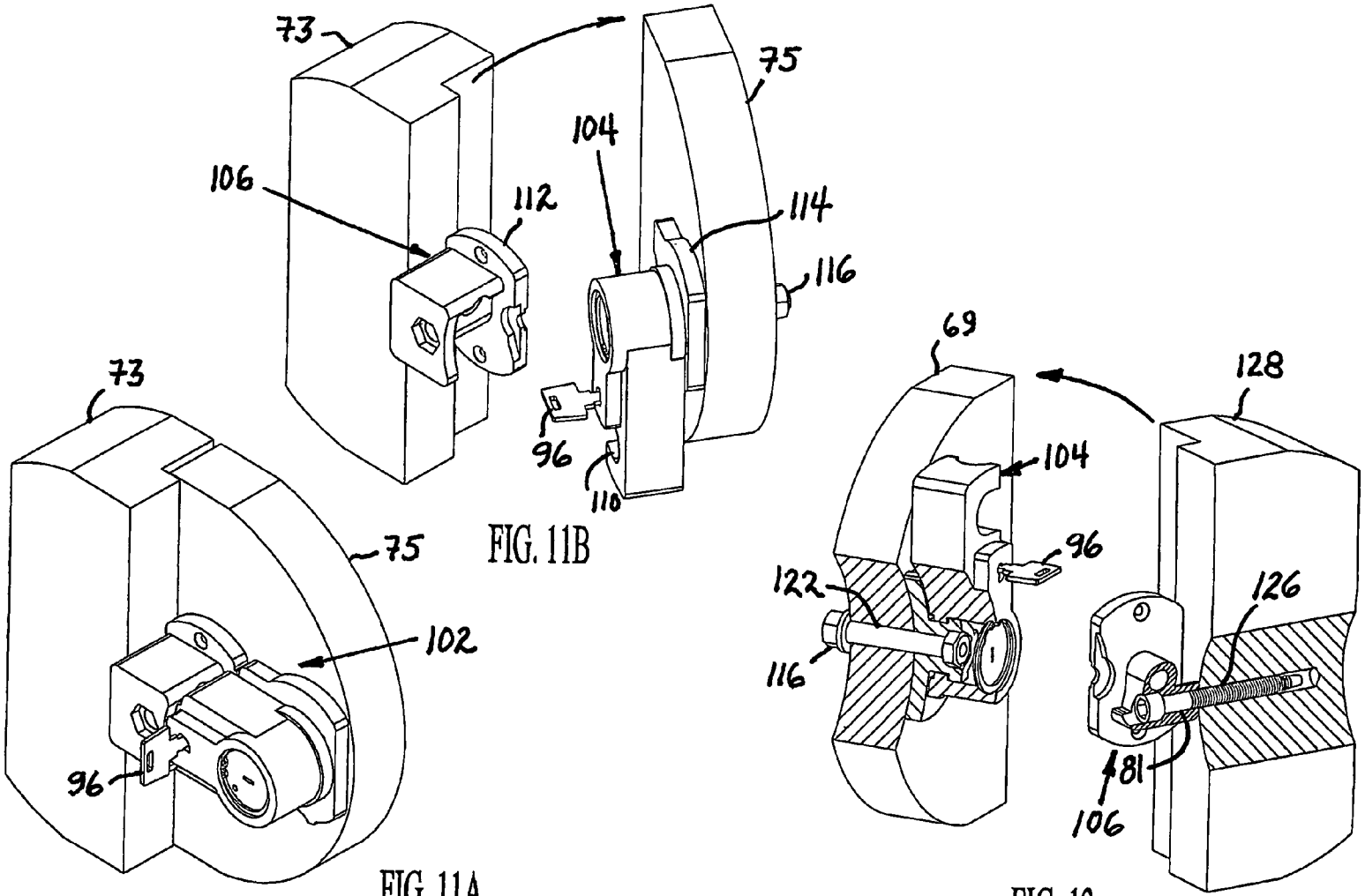
FIG. 11A shows a portion of a single, left-hand door, opening inwardly, which is locked with a bar-lock in accordance with an embodiment of the present invention.
FIG. 11B shows a portion of the door of FIG. 11A opened, with the bar-lock unlocked and secured.
FIG. 12 shows a partial cut-away view of a portion of an open, single, right-hand door, opening inwardly, with the bar-lock being pivoted upwardly, unlocked and secured in place.

FIG. 11A shows a single, right-hand door portion 75, which is locked shut against door post portion 73 using a bar-lock 102 in accordance with a preferred embodiment of the present invention FIG. 11B shows the door portion 75 of FIG. 11A unlocked and opened, and locking bar 104 unlocked and secured in position.

Locking hasp 106 is attached to door post portion 73 through a hexhead bolt 122 inserted in a hole 81 formed in locking hasp 106. Locking bar 104 is mounted to door portion 75 using mounting plate 114 and secured with a fastener 122 (see cut-away in FIG. 12), such as a hexbolt and a nut 116. Key 96 is turned a quarter-turn in its slot to unlock bar-lock 102 and open door portion 75 inwards as indicated by the curved arrow shown in FIG. 11B. Locking bar 104 rotates when unlocked with key 96 and latch portion 119 is shown, by way of example, secured in a downward position. In other applications, latch portion 119 may be unlocked and secured in an upward position as shown, by way of example, in FIG. 12.

FIG. 12 shows a partial cut-away view of a portion of a single, left-hand door 69. Door 69 is shown partially opened and locking bar 104 is shown pivoted upwardly with an engaging means, such as latch portion 119, unlocked and secured in place. Locking hasp 106 is attached to door post 128 with a sturdy listener, such as a hardened bolt 126 (Allen head), as shown in a partial cut-away view. Hardened bolt 126 is inserted through pre-formed hole 81 in keeper 83, enabling use of a much larger and sturdier bolt than usual so as to give bar-lock 102 stronger protection. The locking bar 104 is attached to a portion of door 69 with a hexbolt 122, and locked with lock nut 116.

Figure 13A:
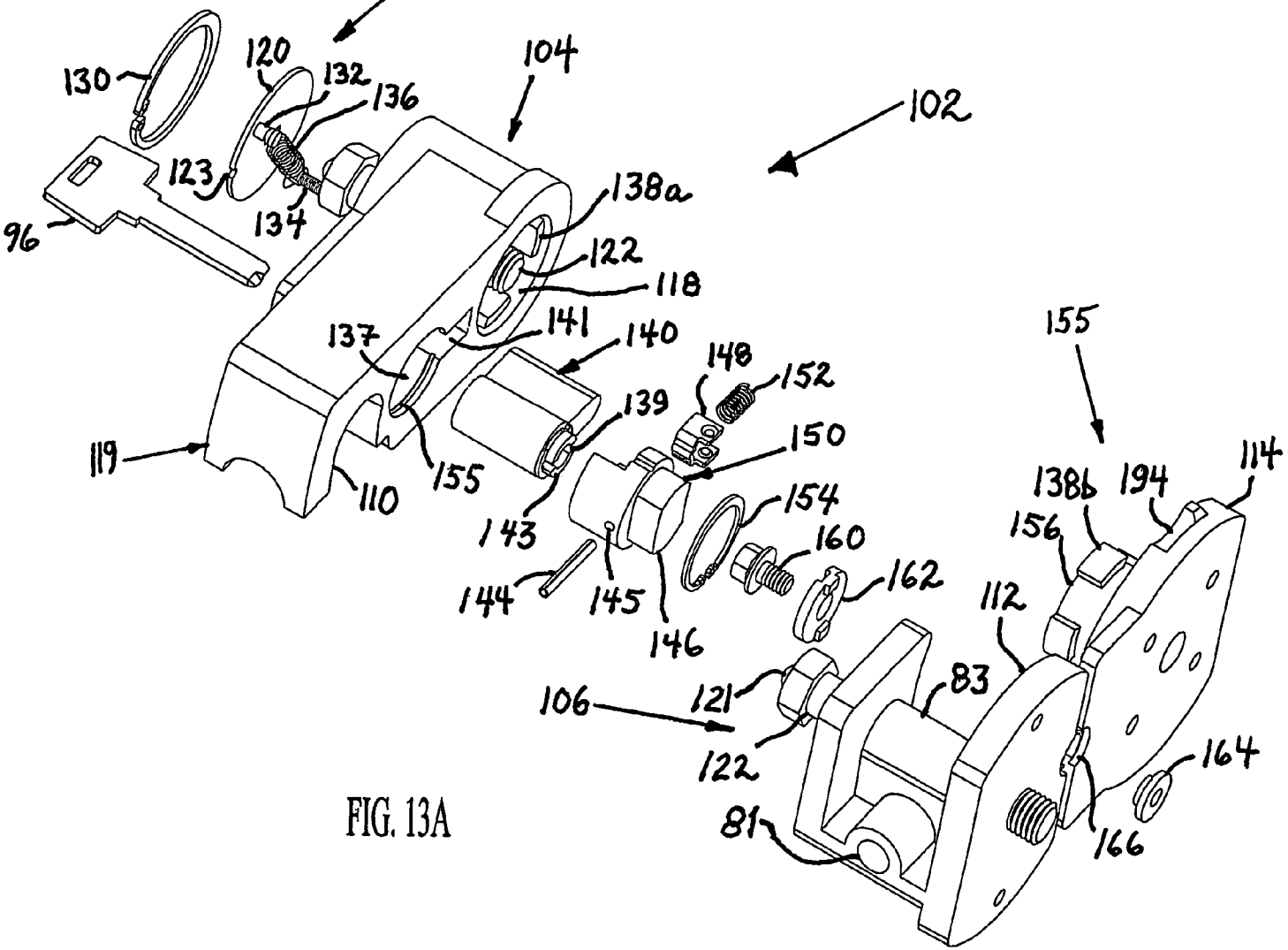
FIGS. 13A-B show exploded views of a bar-lock in a preferred embodiment of the invention.
Figure 13B:
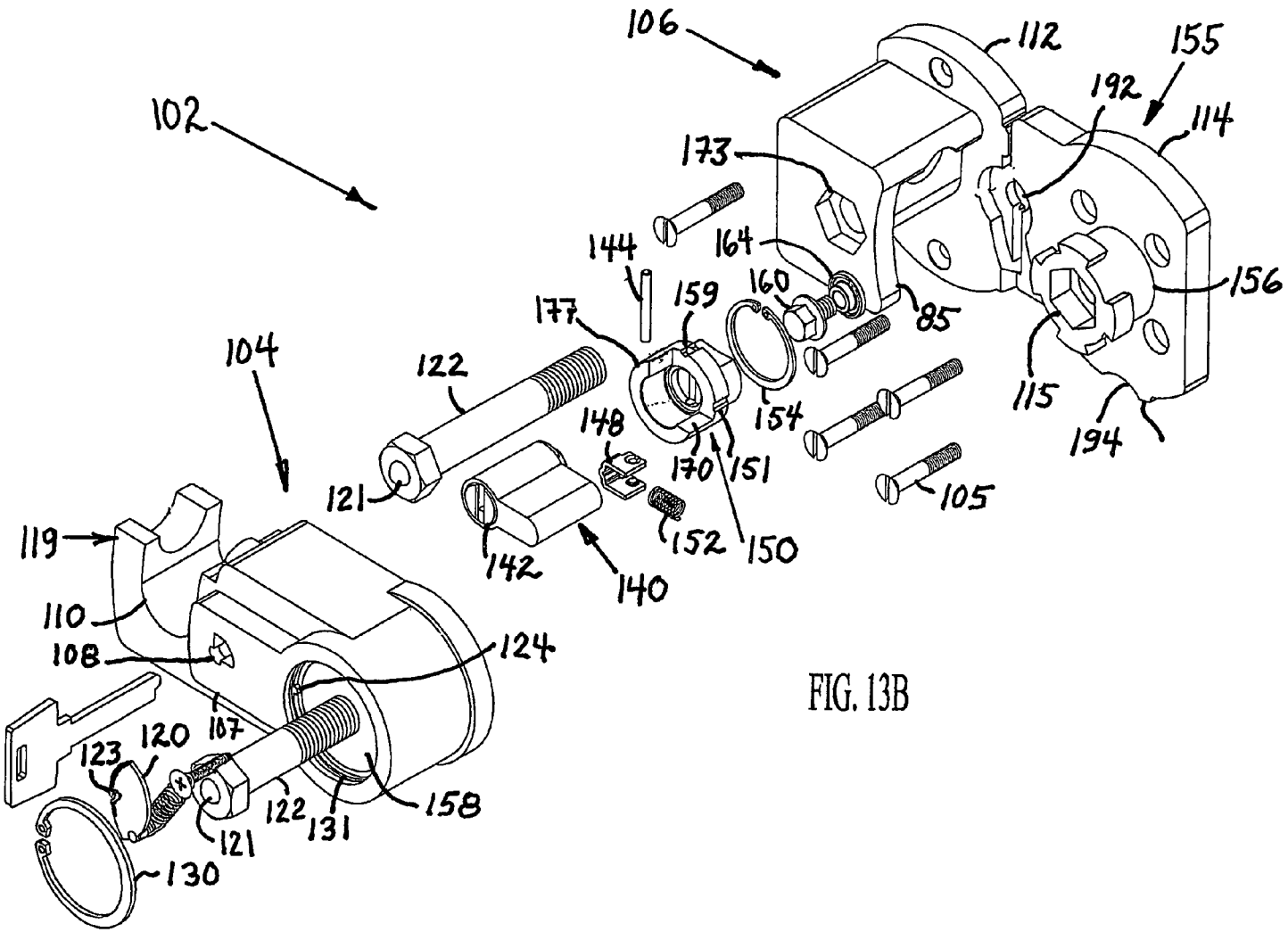

FIGS. 13A and 13B show respective right and left exploded views of a bar-lock in a preferred embodiment of the invention.

Referring to FIG. 13A, the pivotal bar-lock is shown from a right perspective view and includes the major elements: an anchor hasp 155 laterally joined with a locking hasp 106, and a locking bar 104. A locking washer assembly comprising a locking washer 162, a fastener 160, and a threaded end-cap 164 which is seated flush with the outer faces of the first and second mounting plates 114 and 112.

Locking hasp 106 is formed with bar keeper 83 and a convenient pre-formed hole 81 for a fastener 126 for lateral mounting of locking hasp 106 on a door post of an inward-opening door as in FIGS. 11-12. Another hexbolt 122 is inserted through keeper 83 to extend beyond the mounting plate 112 and is secured on its proximal threaded end with a washer and nut (not shown).

Locking bar 104 encases a cylinder lock 140 operable by key 96. Cylinder lock 140 is fitted with a cylinder plug 143 for interacting with a locking cam assembly 150 which rotates with the rotation of cylinder plug 143. This rotation effectuates movement of the cam portion 146 and enables rotation of locking bar 104. Cam portion 146 movement occurs in a locking means, such as that formed within mounting plate 112 (see FIG. 26, 30, 34), or, alternatively, such as a channel as in FIGS. 7 and 9.

In the embodiment of the invention shown in FIGS. 13A-B, an engagement means, such as latch portion 119 formed in locking bar 104 is illustrated. A spring assembly 131 is disposed within a well 118 which is oriented in a manner so as to assist in rotating locking bar 104 in either direction, to a closed or open position, Spring assembly 131 comprises: a retaining ring 130, a round cover 120 having a small notch 123 on one edge, a small rivet 132 mounted to the inside surface of cover 120 and attached to spring 136. The other end of spring 136 is attached to a small screw 134 mounted on hub 156.

The shaped key opening 108 (FIG. 13B) of the cylinder lock 140 also helps to reduce the size of the opening which makes it more difficult for an intruder to force open the lock.

Mounting plates 112, 114, when joined together with tightening assembly 167 (FIG. 41) in a common plane, serve as a built-in template for accurate placement and perfect alignment of the drilling holes to mount inventive bar-lock 102 on various types of doors and door posts using common fasteners, such as metal screws, bolts, and the like.

FIG. 13B is a left perspective view of bar-lock 102 revealing further construction details. Latch portion 119 is formed with a latching channel 110. Cam assembly 150 iis formed with a partial circumferential collar 177, with the collar being supported on the cylinder lock 140, by way of surface 170, thereby eliminating forced-opening pressure acting on an internal mechanism associated with the cylinder lock 140. Hexagonal recesses 115 and 173, respectively associated with locking hub 156 and locking hasp 106, are also shown. Anchor hasp 106 and locking hasp 155 are each mounted with a single main, massive hexbolt 122. In the case of anchor hasp 155, the bolt 122 is coincident with an axis defining the locking bar 104 rotation. Hexbolts 122 are tamper-resistant by virtue of being seating within respective hexagonal recesses 115 and 173 and by virtue of a hardened insert 121. Shaped key opening 108 is formed in hardened wall 107 of locking bar 104.

Figure 14:
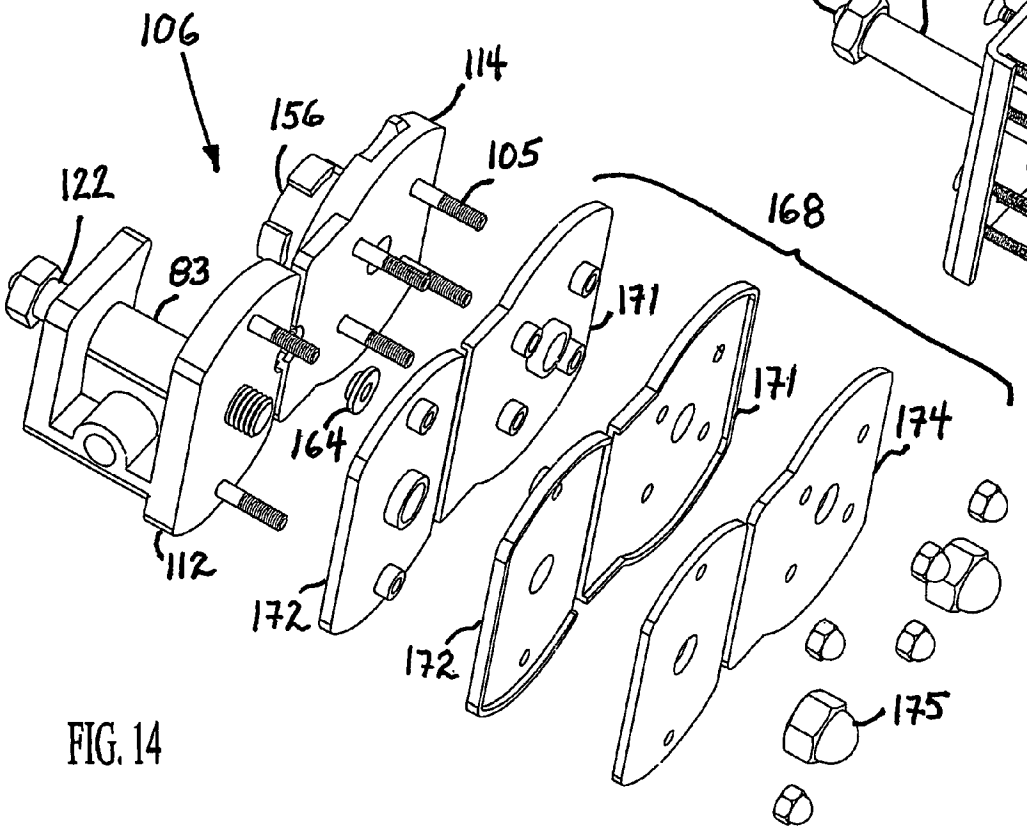
FIG. 14 shows an exploded view of an adapter and related mounting hardware used for attaching the locking hasp of FIG. 13 to a glass door in accordance with the principles of the invention.

FIG. 14 shows an exploded view of an adapter 168 and related mounting hardware including gaskets 171, 172 and capnuts 175 used for attaching the locking hasp and anchor hasp of FIGS. 13A-B to a glass door in accordance with the principles of the present invention.

Figure 15:
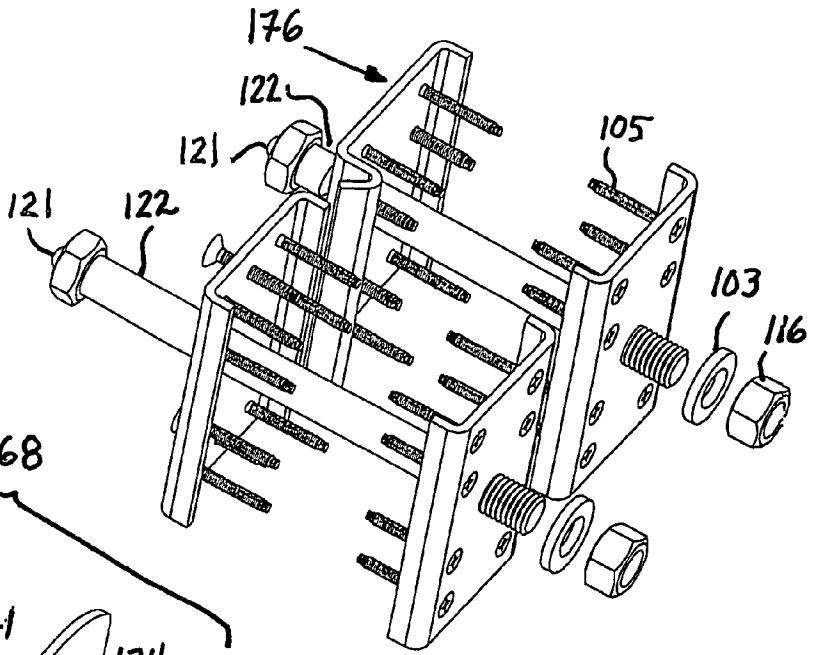
FIG. 15 shows an exploded view of an adapter and fasteners for mounting the bar-lock of FIG. 13 onto an aluminum frame door in accordance with the principles of the invention.

FIG. 15 shows an exploded view of adapters 176 and fasteners for mounting the bar-lock of FIG. 13 onto an aluminum frame door in accordance with the present invention.

Because aluminum frame doors generally are extruded or formed in curved sections, it is difficult to attach a bar-lock to such doors and to assure that there is sufficient contact between adjacent joining surfaces. Adapters 176 are shown with two large, hex-head mounting bolts 122 for anchoring the adapters 176 to a metal-frame door so as to provide a surface to which to attach the invention which will provide more contact between the attached parts and, hence, greatly increase the strength of the attachment. They are secured on the inside of doors with washers 103 and nuts 116.

Figure 16B:
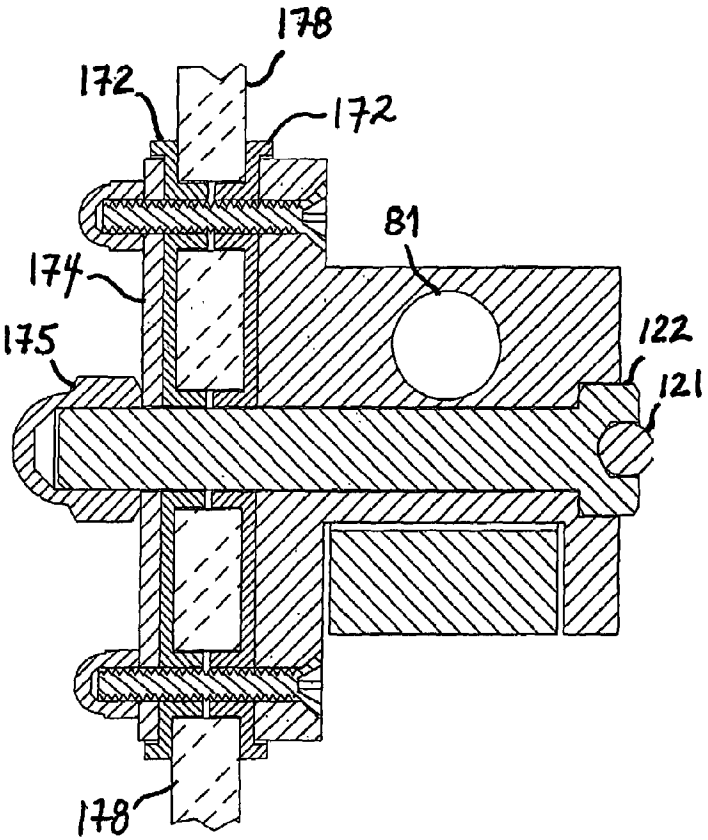
FIG. 16B is a cross-section view of a glass door mounted with the bar-lock of FIG. 16A seen along the axis of a mounting bolt.
Figure 16A:
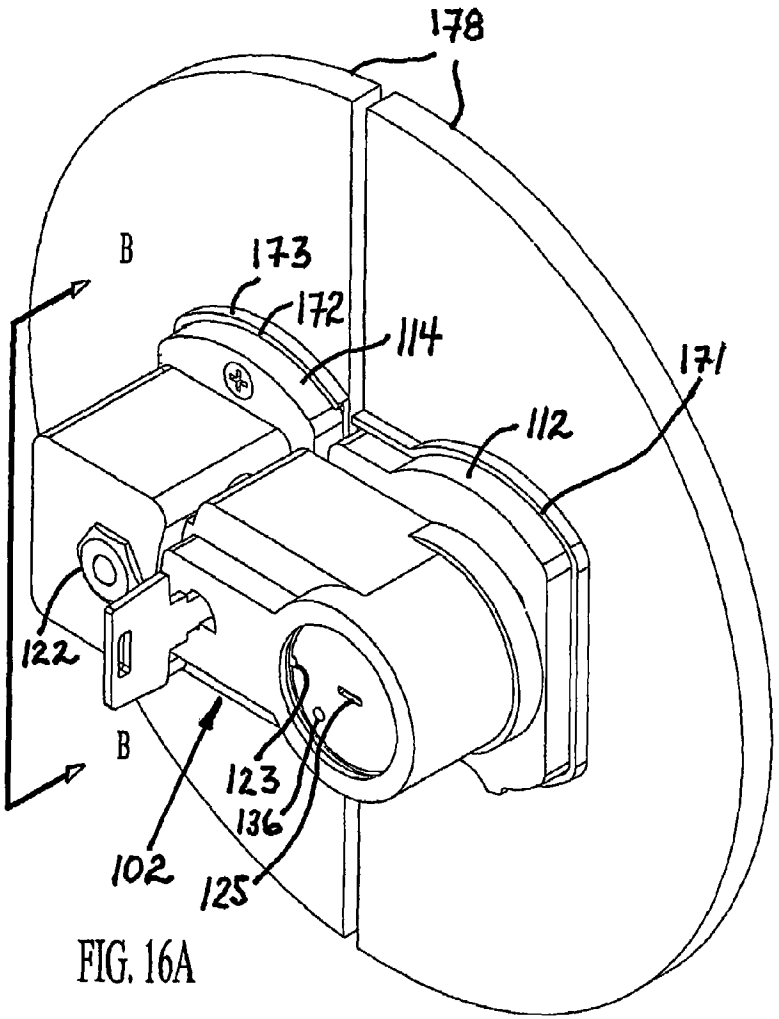
FIG. 16A is a perspective view of a portion of double glass doors with the bar-lock of FIG. 13 mounted thereon, using the adapter of FIG. 14.

FIG. 16A is a perspective view of the bar-lock of FIG. 13 mounted, with the adapter of FIG. 14, onto the rim of a double glass door shown as a portion thereof. Mounting plates 112, 114 provide a flat, metallic surface for the attachment of pivotal bar-lock 102 and are therefore separated by non-metallic gaskets 171, 172 to prevent damage or marring of the glass doors 178.

FIG. 16B is a cross-section view B-B taken along the axis of mounting bolt 122 of FIG. 16A shown with a portion of a glass door 178 mounted with bar-lock 102. Non-metallic gasket 172, backup plate 174 and capnuts 175 are shown on the other side of the door.

Figure 17:
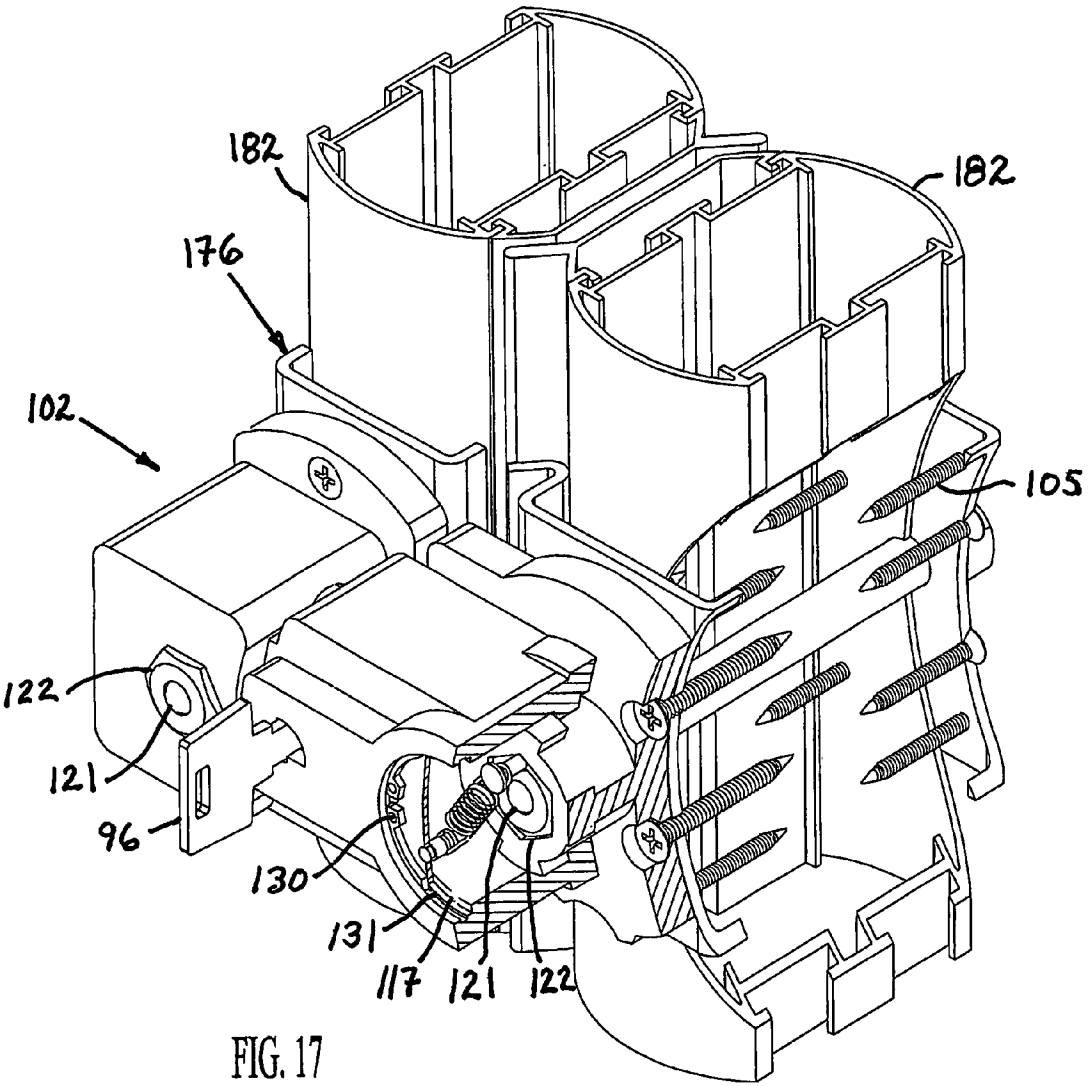
FIG. 17 is a partial cut-away, perspective view of the bar-lock of FIG. 13, with the adapter and fasteners shown in FIG. 15, mounted onto the fires of an aluminum frame door in accordance with the principles of the invention.

FIG. 17 is a partial cut-away, perspective view of the bar-lock of FIG. 13 mounted, in accordance with the principles of the invention, with the adapters and fasteners shown in FIG. 15, onto aluminum frames of a glass door. Adapters 176 provide greater contact surface between adjoining parts and therefore greater strength and security of attachment. Fasteners, such as metal screws 105 are used to attach the pivotal bar-lock 102 across the aluminum door frames 182. Both exterior and interior sides of the door frames 182 are fitted with the flange adapters 176 and secured using a large bolt 122. The adapters 176 are designed to strengthen the connection to the aluminum profile.

Figure 18:
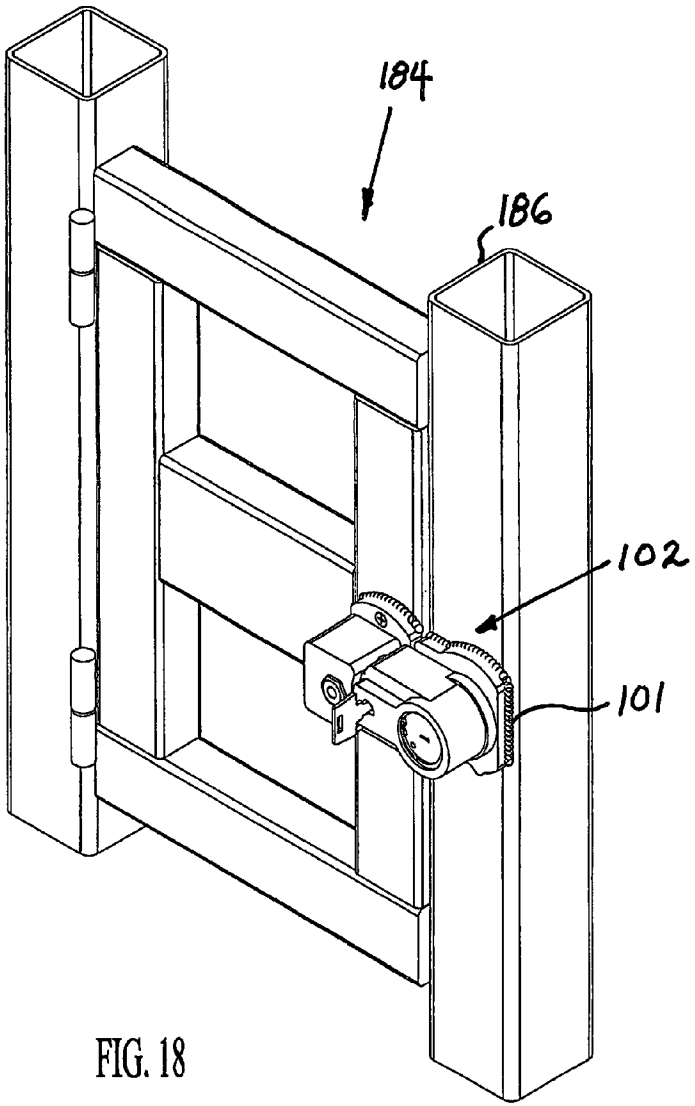
FIG. 18 is a perspective view of the bar-lock of FIG. 1-3 weld-mounted onto a right-hand, outwardly opening gate shown in a shut and locked condition.

FIG. 18 is a perspective view of the pivotal bar-lock of FIG. 13 featuring an arrangement in which bar-lock 102 is metal weld-mounted (as seen at bead 101) onto a right-hand gate shown shut and locked against its gate posts. Optionally, the bar-lock 102 is connected to the metal gate 184 and posts 186 using fasteners, such as bolts. The advantage of welding a bar-lock 102 to the metal gate 184 is to reduce the number of parts, to strengthen the bonding, and to save costs.

Figure 19:
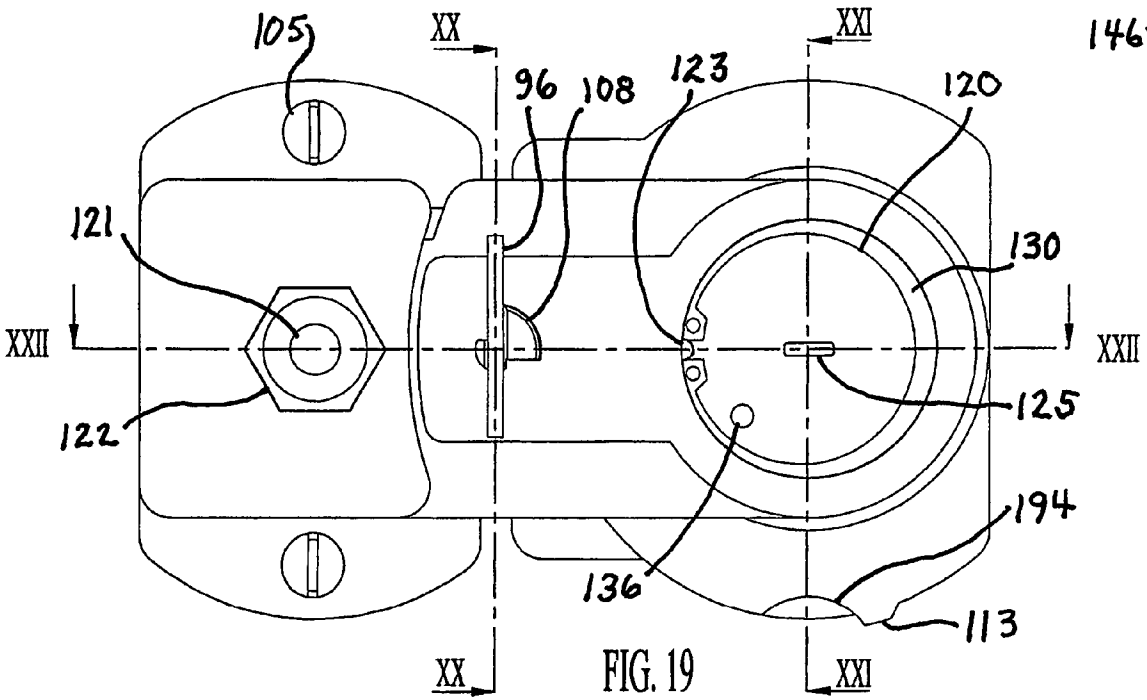
FIG. 19 is a front view of a preferred embodiment of the invention.

FIG. 19 is a front view of a preferred embodiment of the invention. The pivotal bar-lock is illustrated in a locked position. Tool insert notch 125 enables insertion of a tool such as a screwdriver for adjusting the tension in spring 136 so that cover 120 remains in place as established by the alignment of notch 123 and protrusion 124.

Figure 20:
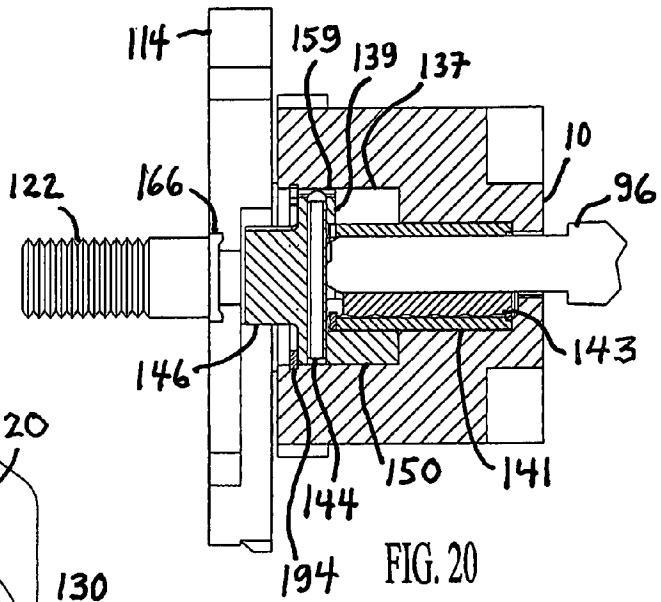
FIG. 20 is a vertical, cross-sectional side view taken along section line XX-XX of the bar-lock of FIG. 19.

FIG. 20 is a vertical, cross-sectional side view taken along section line XX-XX of the bar-lock of FIG. 19. Locking cam assembly 150 is shown seated in aperture 137 of locking bar 104. In addition, roll pin 144 can be seen seated inside slot 139 of cylinder plug 143, forming the rotational connection between the locking cylinder 140 and the cam assembly 150.

Figure 21:
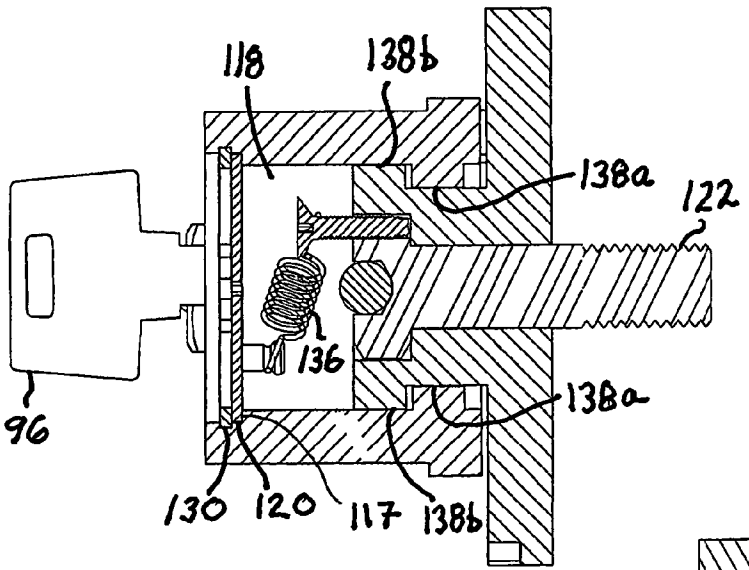
FIG. 21 is a vertical, cross-sectional side view taken along section line XXI-XXI of the bar-lock of FIG. 19 in a locked condition and unopened position.

FIG. 21 is a vertical, cross-sectional side view taken along section line XXI-XXI of the bar-lock of FIG. 19. The cross-section reveals the well 118 enclosing spring 136 fixedly connected to fasteners 132, 134 mounted on opposing surfaces within well 118 so as to casue locking bar 104 to be spring-loaded, thereby establishing the open and closed positions.

Figure 22:
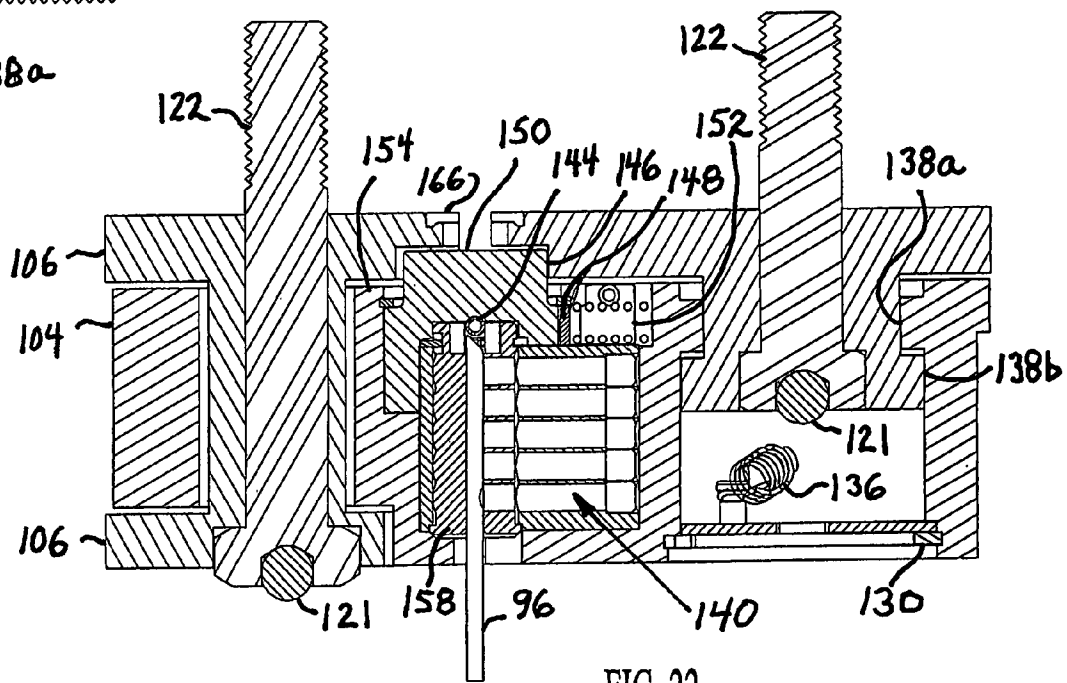
FIG. 22 is a horizontal, cross-sectional top view taken along section line XXII-XXII of the bar-lock of FIG. 19.

FIG. 22 is a horizontal, cross-sectional top view taken along section line XXII-XXII of the bar-lock of FIG. 19. This view shows the two large hexbolts 122 for mounting pivotal bar-lock 102 to a door. In addition, locking cam assembly 150 is visible, seated on cylinder assembly 140, and rotationally connected to slot 139 of cylinder plug 143. Also visible are spring-loaded plunger 148 and spring 152, which engages locking notch 151 of locking cam 150.

Figure 23:
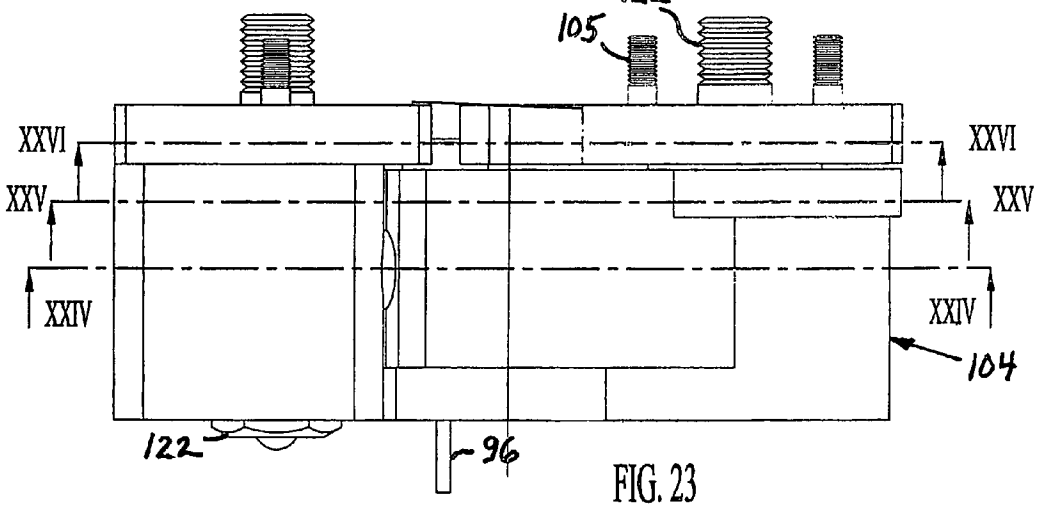
FIG. 23 is a top view of the bar-lock of FIG. 19.

FIG. 23 is a top view of the bar-lock of FIG. 19 shown in a locked position.

Figure 24:
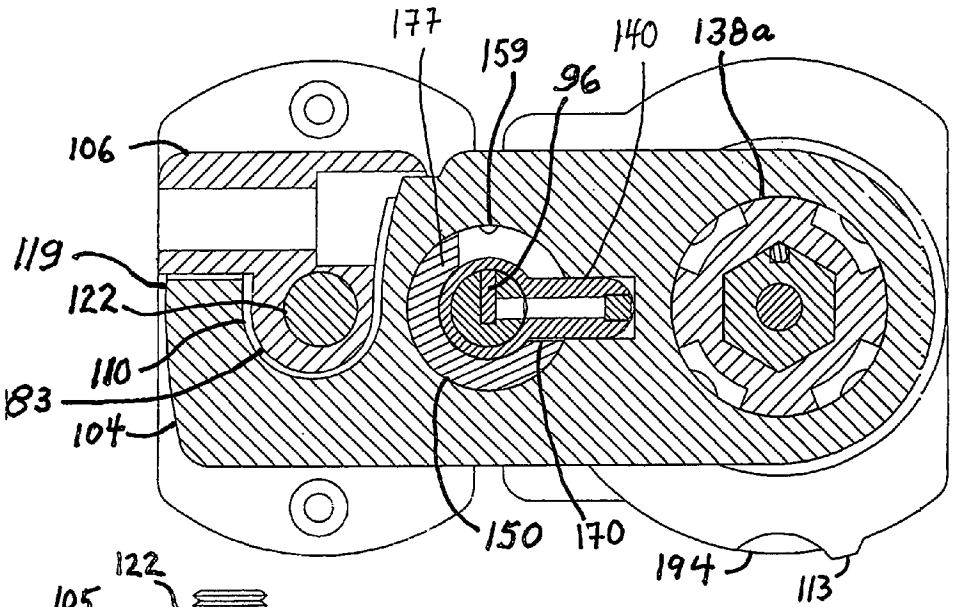
FIG. 24 is a horizontal, cross-sectional front view taken along section line XXIV-XXIV of the bar-lock of FIG. 23.

FIG. 24 is a horizontal, cross-sectional front view taken along section line XXIV-XXIV of the bar-lock of FIG. 23. The latching channel 110 of locking bar 104 is shown engaging the keeper 83 formed integrally with locking hasp 106. The circumferential collar 177 is shown with surface 170 in contact locking cylinder 140. Also visible is stopper 113 which limits travel of locking bar 104 when in the open position. of the bar-lock of FIG. 23. Spring loaded plunger 148 and spring 152 engage a locking notch 151 formed on locking cam assembly 150 to produce an audible click which can also be sensed to positively indicate the locking and unlocking action of cylinder lock 140 when key-operated. Roll pin 144 can is visible, shown mounted inside locking cam assembly 150, which engages slot 139 of cylinder plug 148.

Figure 26:
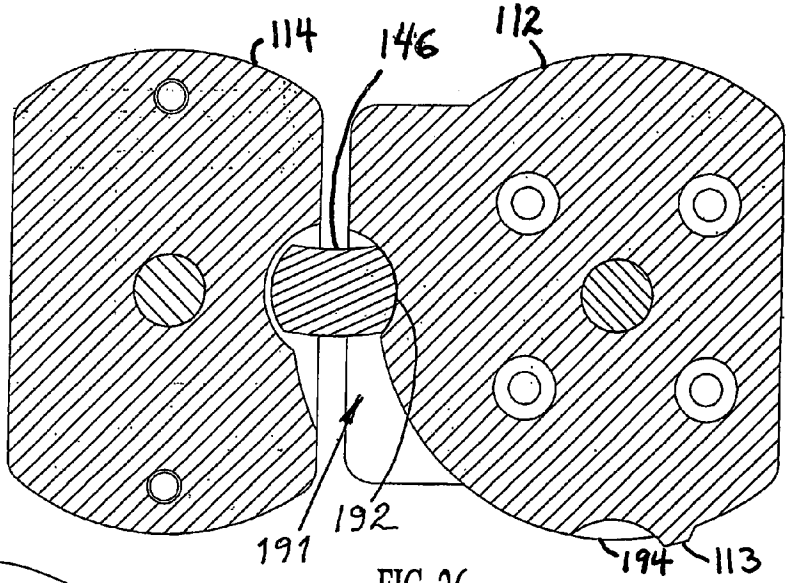
FIG. 26 is a horizontal, cross-sectional front view taken along section line XXVI-XXVI of the bar-lock of FIG. 23.
Figure 25:
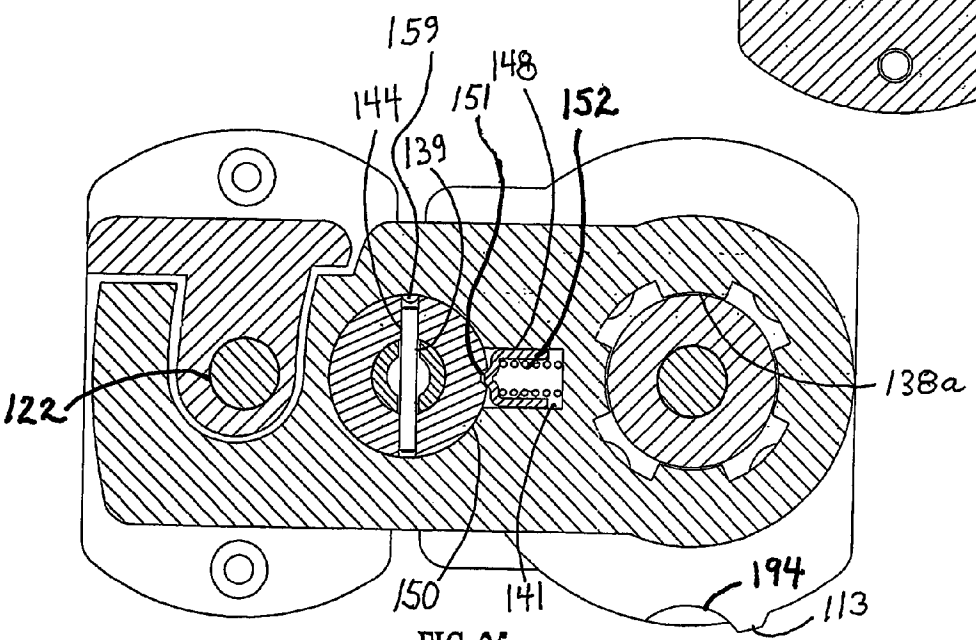
FIG. 25 is a horizontal, cross-sectional front view taken along section line XXV-XXV of the bar-lock of FIG. 23.

FIG. 26. is a horizontal, cross-sectional front view taken along section line XXVI-XXVI of the bar-lock of FIG. 23. The locking cam 146 is revealed seated in closed position locking bay 192 formed between mounting plates 112 and 114. The closed position locking bay 192 and the open position locking bay 194 are disposed at opposing ends of locking channel 191.

Figure 27X:
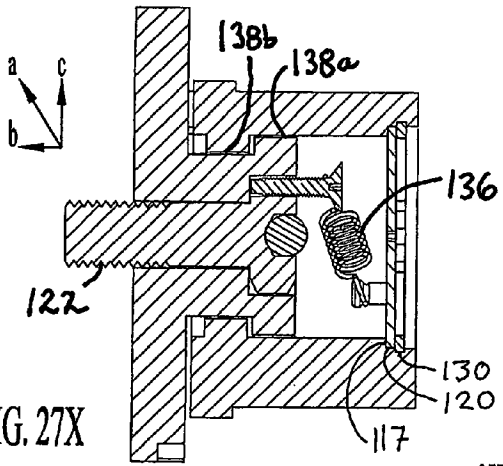
FIG. 27X is a vertical, cross-sectional view taken along section line XXXVI-XXXVI of the bar-lock of FIG. 27.
Figure 27:
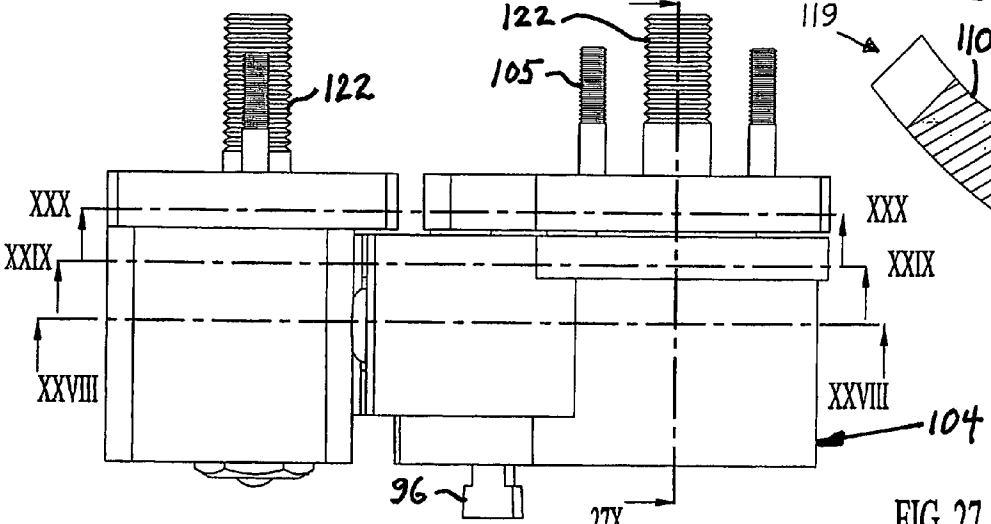
FIG. 27 is a top view of the bar-lock of FIG. 19 in a half-open position.

FIG. 27 is a top view of the bar-lock of FIG. 19 in the in-transit position.

FIG. 27X is a vertical, cross-sectional view taken along section line XXXVI-XXXVI of the bar-lock of FIG. 27. The spring 136 is seen at a different angle attached to its supporting fasteners. The locking bar 104 is spring-loaded to establish the open and closed positions, and spring 136 additionally assists in maintaining the locking bar 104 on the anchor hasp 155, preventing accidental removal of the locking bar 104 by exerting a pulling force in the direction of vector b.

Figure 28:
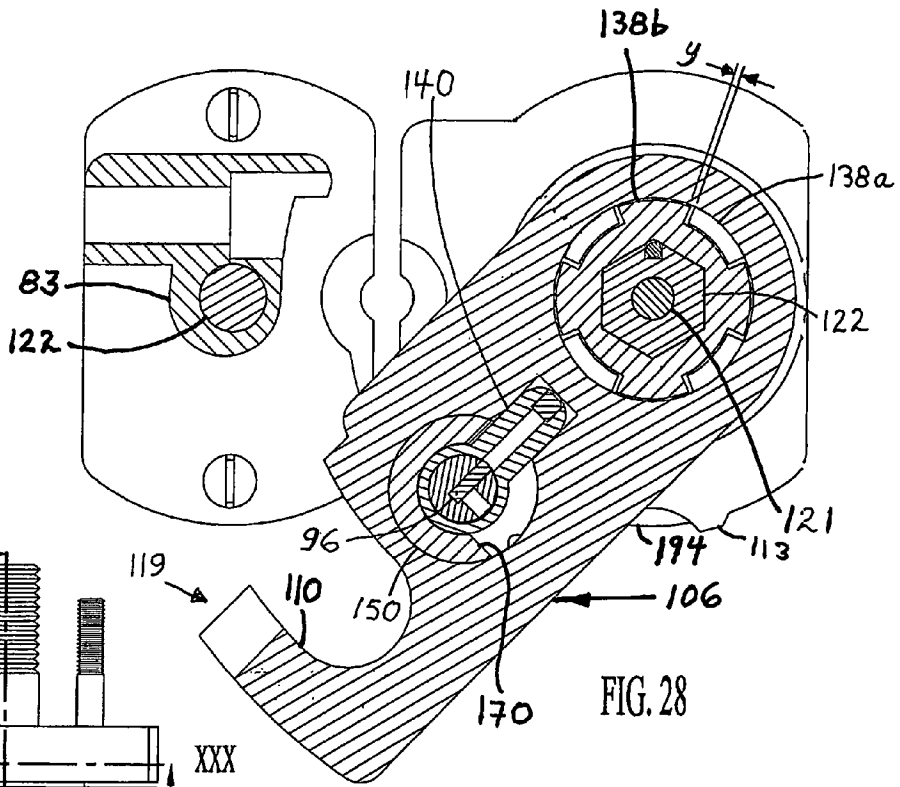
FIG. 28 is a horizontal, cross-sectional front view taken along section line XXVIII-XXVIII of the bar-lock of FIG. 27.

FIG. 28 is, a horizontal, cross-sectional front view taken along section line XXVIII-XXVIII of the bar-lock of FIG. 27. First connecting means 138*a* and second connecting means 138*b* are shown, as well as the clearance "y" between them. The locking bar 104 can be disassembled from the anchor hasp 155 for maintenance purposes, when clearance "y" is established between the first and second connecting means 138*a* and 138*b*.

Figure 29:
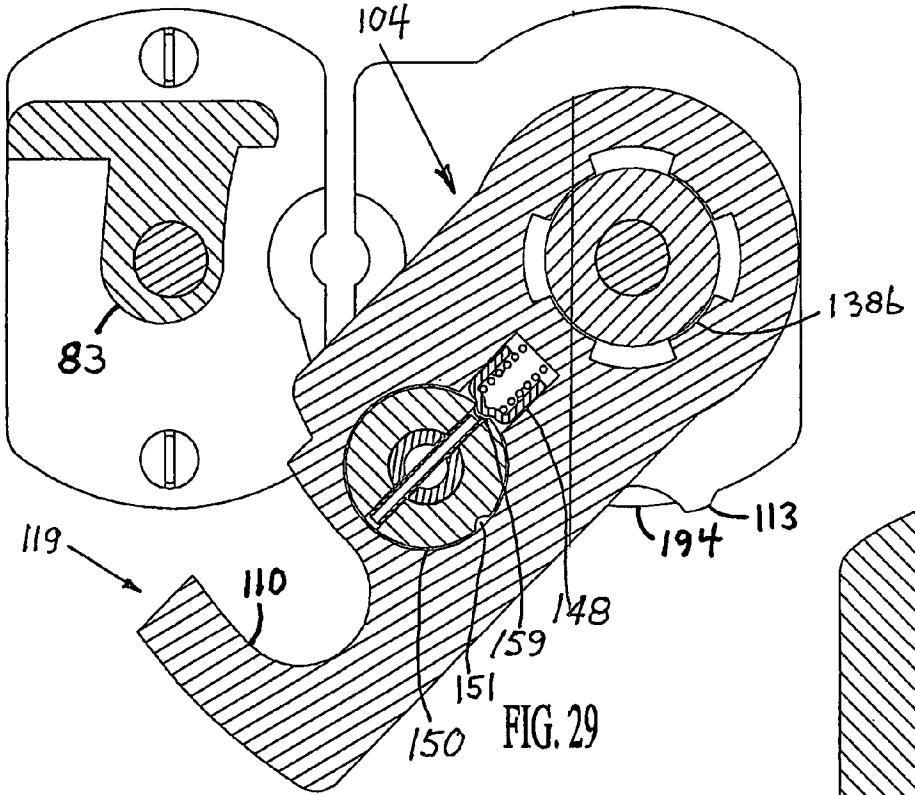
FIG. 29 is a horizontal, cross-sectional view taken along section line XXIX-XXIX of the bar-lock of FIG. 27.

FIG. 29 is a horizontal, cross-sectional front view taken along section line XXIX-XXIX of the bar-lock of FIG. 27. Spring-loaded plunger 148 can be seen engaging unlocking notch 159, defining the in-transit position of locking bar 104.

Figure 30:
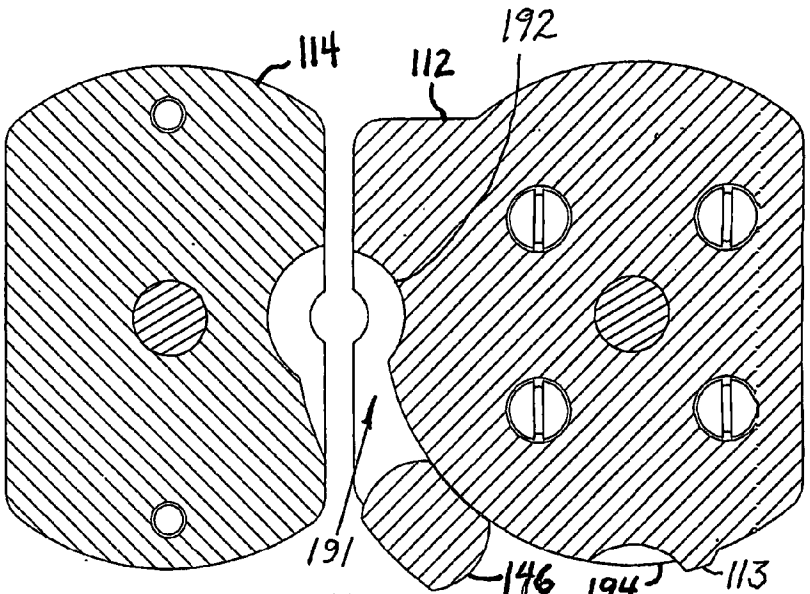
FIG. 30 is a horizontal, cross-sectional view taken along section line XXX-XXX of the bar-lock of FIG. 27.

FIG. 30 is a horizontal, cross-sectional front view taken along section line XXX-XXX of the bar-lock of FIG. 27. Illustrated is the in-transit position of cam 146 along locking channel 191.

Figure 31:
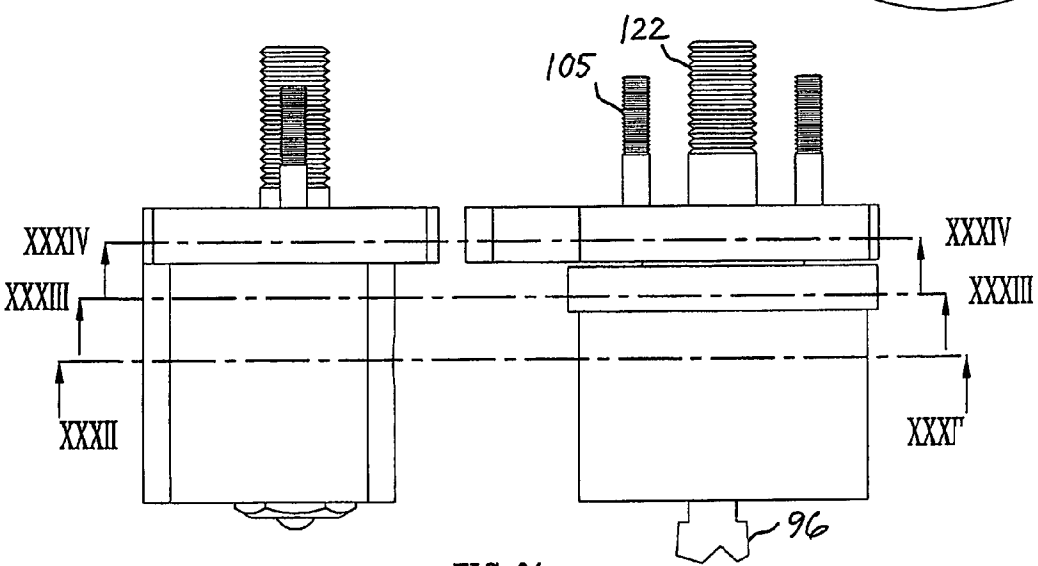
FIG. 31 is a front view of a preferred embodiment of the invention with the barlock in an unlocked and secured position.

FIG. 31 is a top view of a preferred embodiment of the invention with the bar-lock in an unlocked and secured position.

Figure 32:
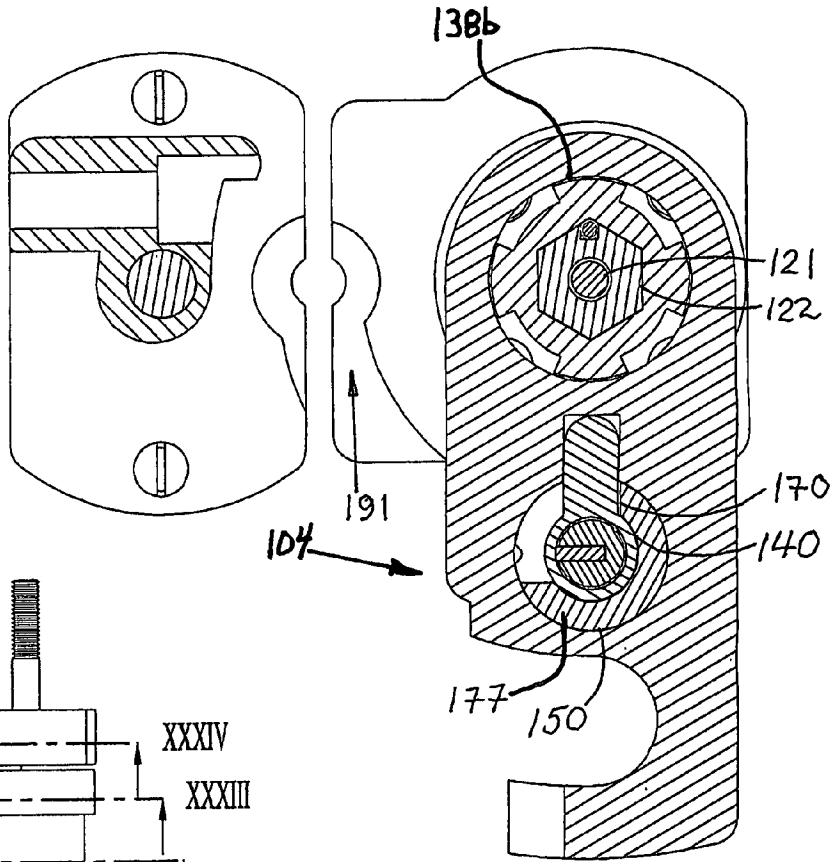
FIG. 32 is a horizontal, cross-sectional view taken along section line XXXII-XXXII of the bar-lock of FIG. 31.

FIG. 32 is a horizontal, cross-sectional front view taken along section line XXXII-XXXII of the bar-lock of FIG. 31. The locking bar 104 is disposed in a downward orientation, unlocked and secured. Locking surface 170 of locking cam assembly 150 is shown in contact with locking cylinder 140.

Figure 33:
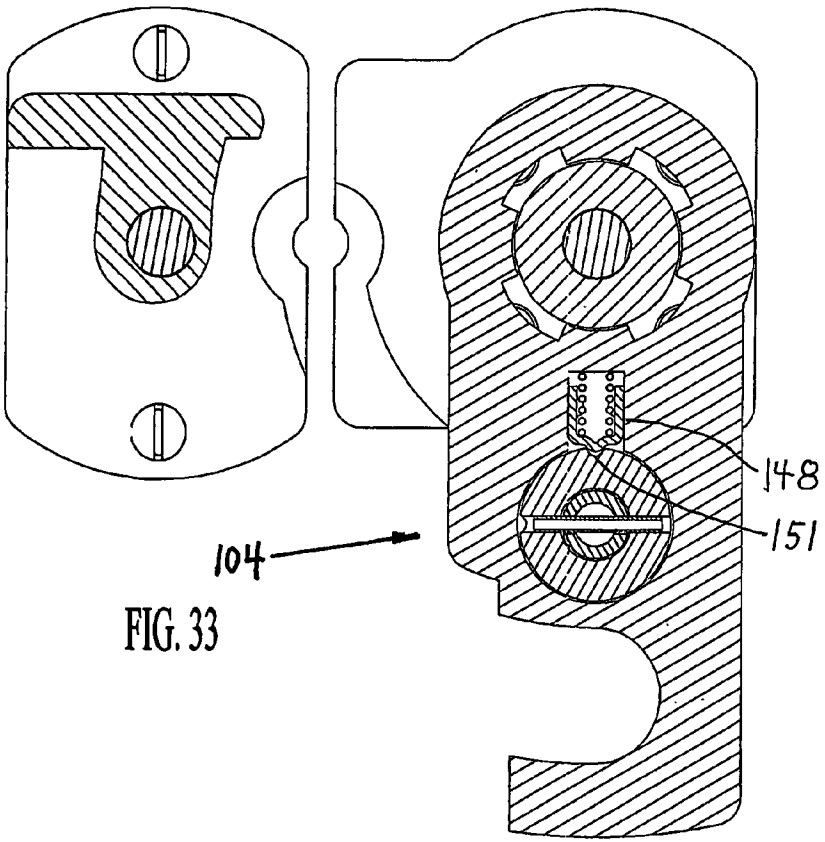
FIG. 33 is a horizontal, cross-sectional view taken along section line XXXIII-XXXIII of the bar-lock of FIG. 31.

FIG. 33 is a horizontal, cross-sectional front view taken along section line XXXIII-XXXIII of the bar-lock of FIG. 31. Spring-loaded plunger 148 engages locking position notch 151, defining the locked position of locking cylinder 140.

Figure 34:
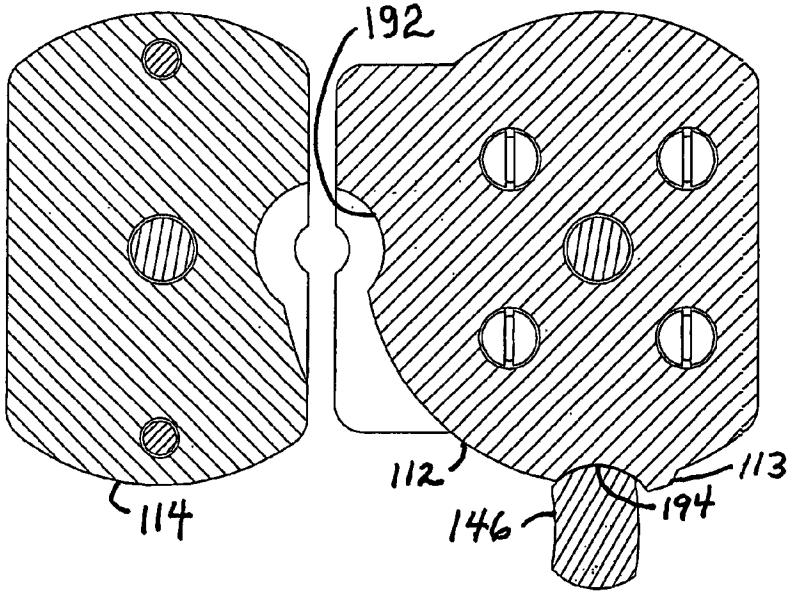
FIG. 34 is a horizontal, cross-sectional view taken along section line XXXIV-XXXIV of the bar-lock of FIG. 31.

FIG. 34 is a horizontal, cross-sectional front view taken along section line XXXIV-XXXIV of the bar-lock of FIG. 31. Cam 146 is clearly visible in a secured position engaging open position locking bay 194.

Figure 37:
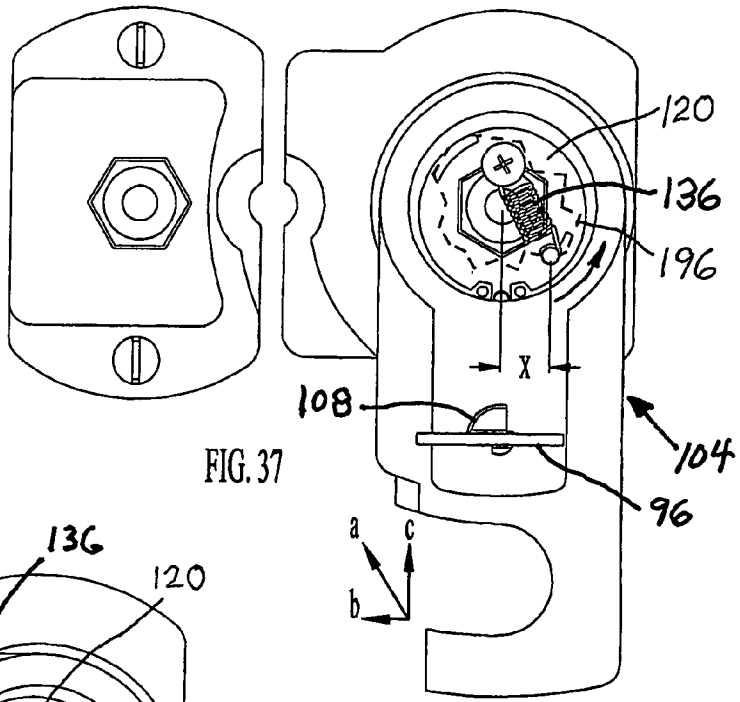
FIG. 37 is a front view of the bar-lock from FIG. 35, unlocked and secured in position, with an exposed view of the position of a spring and an associated vector diagram indicating the forces acting thereon.
Figure 36:
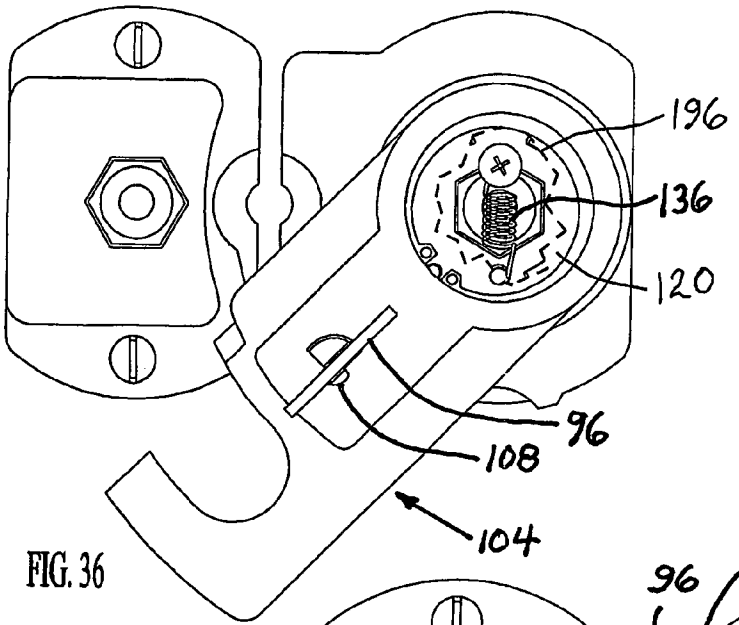
FIG. 36 is a front view of the bar-lock from FIG. 35 in a halfway open, unlocked position with an exposed view of the position of a spring.
Figure 35:
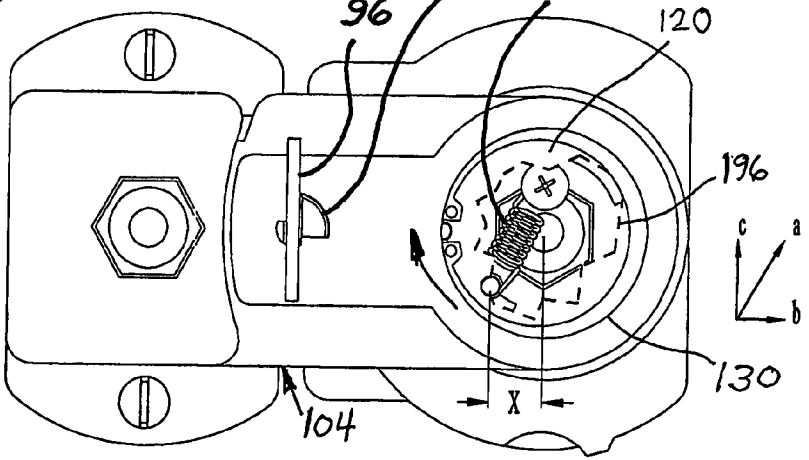
FIG. 35 is a front view of a preferred embodiment of the invention illustrating the locked position of a bar-lock and showing the position of an exposed spring and the vector forces applied thereto for resisting unauthorized attempts to open the bar-lock.

FIGS. 35-37 are front views of a preferred embodiment of the invention illustrating the forces exerted by spring 136 on locking bar 104, using a force vector diagram. The illustrations reveal spring 136 via a cutout portion defined by the dashed line 196. In FIG. 35, the spring 136 exerts force c, at offset distance "x". causing the locking bar 104 to rotate into the closed position, as indicated by the curved arrow. The spring 136 will hold the locking bar 104 in this position until it will be locked by locking cylinder 140. This enables one-handed operation.

In FIG. 36, spring 136 does not exert any rotational forces on locking bar 104, while in the in-transit position, because there is no offset distance.

In FIG. 37, spring 136 exerts a rotational force in the opposite direction, to bring locking bar 104 into the unlocked position, by exerting force c, at offset distance "x" in the direction of the curved arrow.

FIGS. 38-41 are illustrations showing tightening assembly 167 for joining anchor hasp 155 and locking hasp 106 in a common plane, to serve as a built-in template for complete, accurate, safe and easy installation of bar-lock 102.

Figure 38:
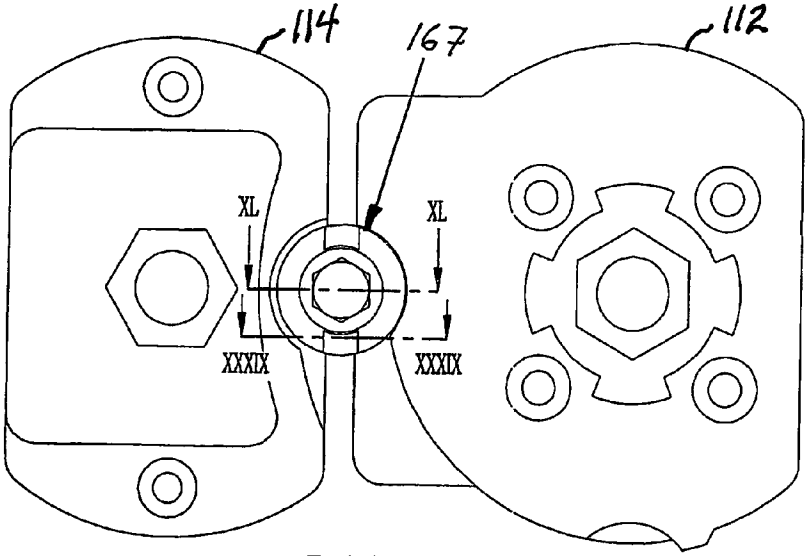
FIG. 38 is a front view of an alignment washer for aligning and joining a first mounting plate with a second mounting plate of a pivotal bar-lock in accordance with an embodiment of the invention.
Figure 39:
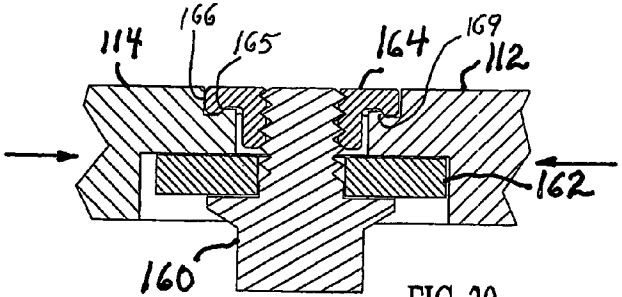
FIG. 39 is a horizontal, cross-sectional top view taken along section line XXXIX-XXXIX of the alignment washer of FIG. 38.

FIG. 39 is a horizontal, cross-sectional view taken along section line XXXIX-XXXIX of the tightening assembly 167 of FIG. 38.

Figure 40:
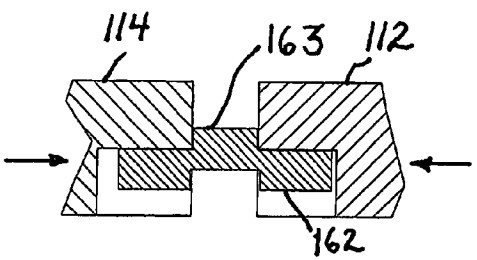
FIG. 40 is a horizontal, cross-sectional top view taken along section line XL-XL of the alignment washer of FIG. 38.

FIG. 40 is a horizontal, cross-sectional view taken along section line XL-XL of the tightening assembly 167 of FIG. 38.

Figure 41:
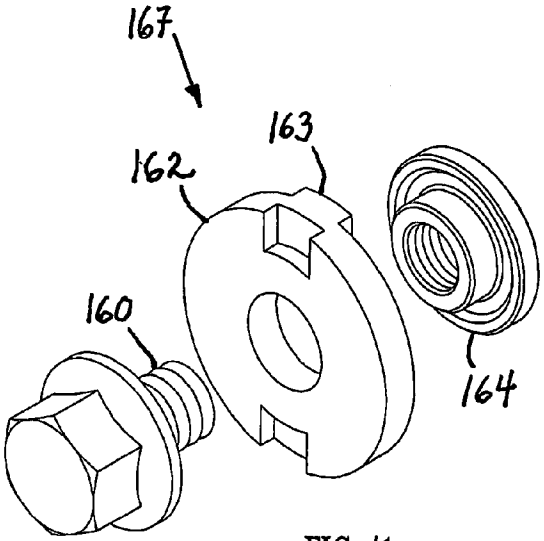
FIG. 41 is an enlarged, exploded view of the alignment washer assembly of the invention, in a preferred embodiment thereof.

FIG. 41 is an enlarged, exploded view of the tightening assembly 167 of the invention.

When bolt 160 is tightened, capnut 164 is drawn inwardly, thus drawing together mounting plates 112 and 114 in the direction of the arrows, by action of sloped recess 165 of capnut 164 against sloped protrusion 169 of each of mounting plates 112 and 114. The alignment between mounting plates 112 and 114 is guided by oppositely-situated protrusions 163 of locking washer 162. Once the alignment is achieved and the mounting template is established, the mounting installation can proceed, after which the tightening assembly 167 is removed.

Having described the invention with regard to certain specific embodiments, it is to be understood that the description is not meant as a limitation, since further modifications may now suggest themselves to those skilled in the art, and it is intended to cover such modifications as fall within the scope of the described invention and with reference to the accompanying drawings.

I claim:

1. A pivotal bar-lock, comprising:

an anchor hasp comprising a locking hub and a first locking means integrally formed with a first mounting plate;

a locking hasp integrally formed with a second mounting plate and having a mating element and a second locking means formed therein; and a locking bar rotatably mounted on said anchor hasp, said locking bar having a cylinder lock encased therein and an engagement means formed therewith;

said cylinder lock being operable such that when rotated into an unlocked mode, said locking bar is pivotally enabled to assume one of open and closed positions in interaction with said first and second locking means, and when said cylinder lock is rotated into a locked mode, said engagement means of said locking bar engages said mating element of said locking hasp, said bar-lock being constructed without seams, protrusions, orifices, and physical features commonly subject to attempts at forced intrusions and open to attack by use of a crowbar, saw, wire cutter, drill and other similar implements, wherein said first and second locking means comprise a channel having formed therein a first locking bay defined as a closed position locking bay, and a second locking bay defined as an open position locking bay, said first and second locking bays being disposed at opposing ends of said channel, and wherein when said locking bar is pivoted to disengage from said mating element of said locking hasp, a locking cam engages said open position locking bay, securing said locking bar in said open position.

2. The bar-lock of claim 1, wherein said looking bar is spring-loaded to establish said open and closed positions, enabling said bar-lock to be operated with one hand.

3. The bar-lock of claim 1, wherein said locking hasp and said anchor hasp are laterally joined in the same plane by a tightening assembly to define a mounting template for complete, accurate, safe and easy installation.

4. The bar-lock of claim 1, wherein said template is designed to accept auxiliary mounting screws to assist in said installation.

5. The bar-lock of claim 1, wherein said first mounting plate of said anchor hasp and said second mounting plate of said locking hasp are co-planar.

6. The bar-lock of claim 1, wherein said locking hasp has a mounting surface additional to said second mounting plate, which is not co-planar with said second mounting plate.

7. The bar-look of claim 1, wherein said anchor hasp is mounted with a single main, massive fastening means coincident with an axis defining said locking bar rotation, said fastening means being tamper-resistant.

8. The bar-lock of claim 1, wherein said locking bar serves as a locking bolt.

9. The bar-lock of claim 1, wherein a locking cam engages said closed position locking bay when said locking bar is pivoted to engage said mating element of said locking hasp, locking said pivotal bar-lock.

10. The bar-lock of claim 9, wherein said locking cam is farmed with a partial circumferential collar, said collar being supported on said cylinder lock, thereby eliminating forced-opening pressure acting on an internal mechanism associated with said cylinder lock.

11. The bar-look of claim 10, wherein said collar is formed with at least one notch which engages a spring-loaded plunger to define at least one of said open, in-transit and closed positions.

12. The bar-lock of claim 1, wherein said anchor hasp is integrally formed with a first set of connecting means, and said locking bar is integrally formed with a second set of connecting means, said first and second connecting means being rotatably interlocked in said open and closed positions, preventing disassembly of said locking bar from said anchor hasp.

13. The bar-lock of claim 12, wherein said locking bar can be disassembled from said anchor hasp for maintenance purposes, when said locking bar is in said in-transit position to enable clearance of said first and second connecting means.

14. The bar-lock of claim 12, wherein said locking bar is spring-loaded to establish said open and closed positions, said spring additionally assisting in maintaining said locking bar on said anchor hasp, preventing accidental removal of said locking bar.

15. The bar-lock of claim 1, wherein said engagement means is provided by a latch portion of said locking bar which is rotatable to engage said mating element of said looking hasp in said closed position, and said cylinder lock is operable to lock it therein.

16. The bar-lock of claim 15, wherein said latch portion has at least one latching channel.

17. The bar-lock of claim 1, wherein at least one of said anchor hasp and said locking hasp is mounted using an adapter means.

18. The bar-lock of claim 17, wherein said adapter means enables mounting said pivotal bar-lock on glass doors.

19. The bar-lock of claim 17, wherein said adapter means enables mounting said pivotal bar-lock on aluminum frame doors.

20. The bar-lock of claim 17, wherein said adapter means is a metal weld enabling said pivotal bar-lock to be mounted on a metal frame without fasteners.

21. The bar-lock of claim 1, wherein said cylinder lock is encased in said locking bar thereby preventing tampering by drilling, pulling extractor, and breaking with hand tools.

22. The bar-lock of claim 1, wherein said anchor hasp and locking hasp are mountable on at least one of a variety of doors selected from the group of right-hand and left-hand normal and reversible doors, single and double doors, swinging, sliding, folding, accordion-type, and rotating doors.

23. The bar-lock of claim 22, wherein said doors are constructed of materials selected from at least one of the group of wood, plastic, metal, and glass.

24. A method of locking a door, comprising:

providing a pivotal bar lock, comprising:

an anchor hasp comprising a locking hub and a first locking means integrally formed with a first mounting plate mounted on one of a door and doorpost;

a locking hasp integrally formed with a second mounting plate mounted on the other one of a door and a doorpost, and having a mating element and a second locking means formed therein; and a locking bar rotatably mounted on said anchor hasp, said locking bar having a cylinder lock encased therein and an engagement means formed therewith; and operating said cylinder lock such that when rotated into an unlocked mode, said locking bar is pivotally enabled to assume one of open and closed positions in interaction with said first and second locking means, and when said cylinder lock is rotated into a locked mode, said engagement means of said locking bar engages said mating element of said locking hasp, said bar-lock being constructed without seams, protrusions, orifices, and physical features commonly subject to attempts at forced intrusions and open to attack by use of a crowbar, saw, wire cutter, drill and other similar implements, wherein said first and second locking means comprise a channel having formed therein a first locking bay defined as a closed position locking bay, and a second locking bay defined as an open position locking bay, said first and second locking bays being disposed at opposing ends of said channel, and wherein when said locking bar is pivoted to disengage from said mating element of said locking hasp, a locking cam engages said open position locking bay, securing said locking bar in said open position.

* * * * *